US011168419B2

(12) United States Patent
Mecl et al.

(10) Patent No.: US 11,168,419 B2
(45) Date of Patent: Nov. 9, 2021

(54) NONWOVEN WEB COMPRISING THERMALLY FUSIBLE FIBERS AND BONDING IMPRESSIONS FORMING A PATTERN

(71) Applicant: PFNONWOVENS CZECH S.R.O., Znojmo (CZ)

(72) Inventors: Zdenek Mecl, Novy Saldorf-Sedlesovice (CZ); Jana Kroutilova, Bozice (CZ); Jiri Kummer, Znojmo-Primetice (CZ); Jaroslav Kohut, Znojmo (CZ); Katerina Tvaruzkova, Prosimerice (CZ); Jitka Zerehsaz, Znojmo (CZ); Jitka Svobodova, Znojmo (CZ)

(73) Assignee: PFNONWOVENS CZECH S.R.O., Znojmo (CZ)

( * ) Notice: Subject to any disclaimer, the term of this patent is extended or adjusted under 35 U.S.C. 154(b) by 0 days.

(21) Appl. No.: 16/098,329

(22) PCT Filed: May 2, 2017

(86) PCT No.: PCT/CZ2017/050020
§ 371 (c)(1),
(2) Date: Nov. 1, 2018

(87) PCT Pub. No.: WO2017/190717
PCT Pub. Date: Nov. 9, 2017

(65) Prior Publication Data

US 2019/0161897 A1 May 30, 2019

(30) Foreign Application Priority Data

May 2, 2016 (CZ) ..... PV 2016-250

(51) Int. Cl.
*A61F 13/511* (2006.01)
*D04H 1/54* (2012.01)
*D04H 3/14* (2012.01)

(52) U.S. Cl.
CPC ..... *D04H 1/54* (2013.01); *D04H 3/14* (2013.01)

(58) Field of Classification Search
CPC ..... Y10T 428/24802; Y10T 428/24826; Y10T 13/515; Y10T 13/511; A61F 13/51104;
(Continued)

(56) References Cited

U.S. PATENT DOCUMENTS 4,333,979 A 6/1982 Sciaraffa et al.
6,589,638 B1 7/2003 McCormack et al.
(Continued)

FOREIGN PATENT DOCUMENTS

EP 1322806 A1 7/2003
WO 2004/085730 A1 10/2004

OTHER PUBLICATIONS

European Patent Office; Search Report in related International Patent Application No. PCT/CZ2017/050020 dated Sep. 22, 2017; 3 pages.

*Primary Examiner* — Joanna Pleszczynska
(74) *Attorney, Agent, or Firm* — Amster, Rothstein & Ebenstein LLP

(57) ABSTRACT

A nonwoven web comprising heat bondable fibres and comprising bonding impressions that form a pattern repeated in the machine direction (MD), wherein the bonding impressions include: a system of basic bonding impressions, which are arranged to create visually primary patterns and an area of each basic impression is at least 1 $mm^2$, and a system of auxiliary bonding impressions having the area smaller than 1 $mm^2$, and wherein a sum of bonding areas of the individual
(Continued)

auxiliary bonding impressions accounts for at least 30% of a total bonding area.

22 Claims, 14 Drawing Sheets

(58) Field of Classification Search
CPC ..... A61F 13/51108; A61F 13/15203; A61F 13/15731
See application file for complete search history.

(56) References Cited

U.S. PATENT DOCUMENTS

| | | | | |
|---|---|---|---|---|
| 2003/0093044 | A1 | 5/2003 | Wahlstrom et al. | |
| 2008/0268194 | A1* | 10/2008 | Kim | D04H 3/14 428/43 |
| 2013/0253461 | A1* | 9/2013 | Xu | A61F 13/511 604/384 |

* cited by examiner

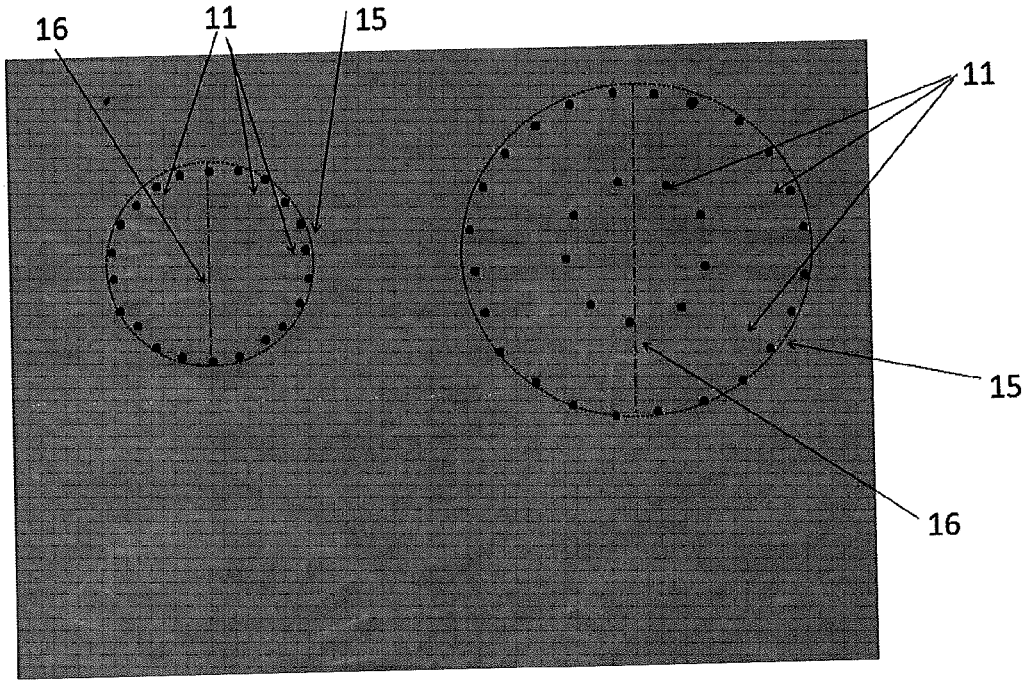
Fig.11-i
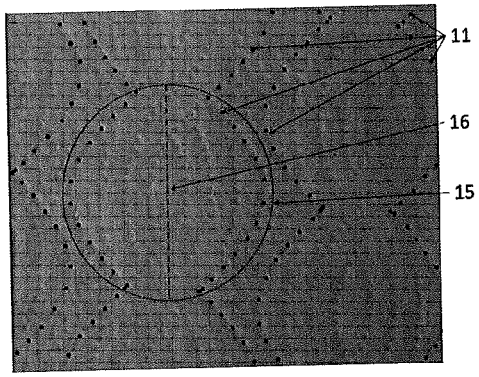
Fig.11-ii
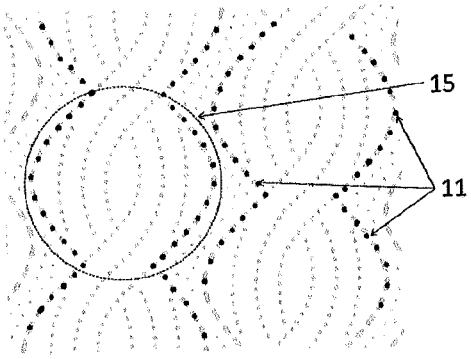
Fig.11-iii

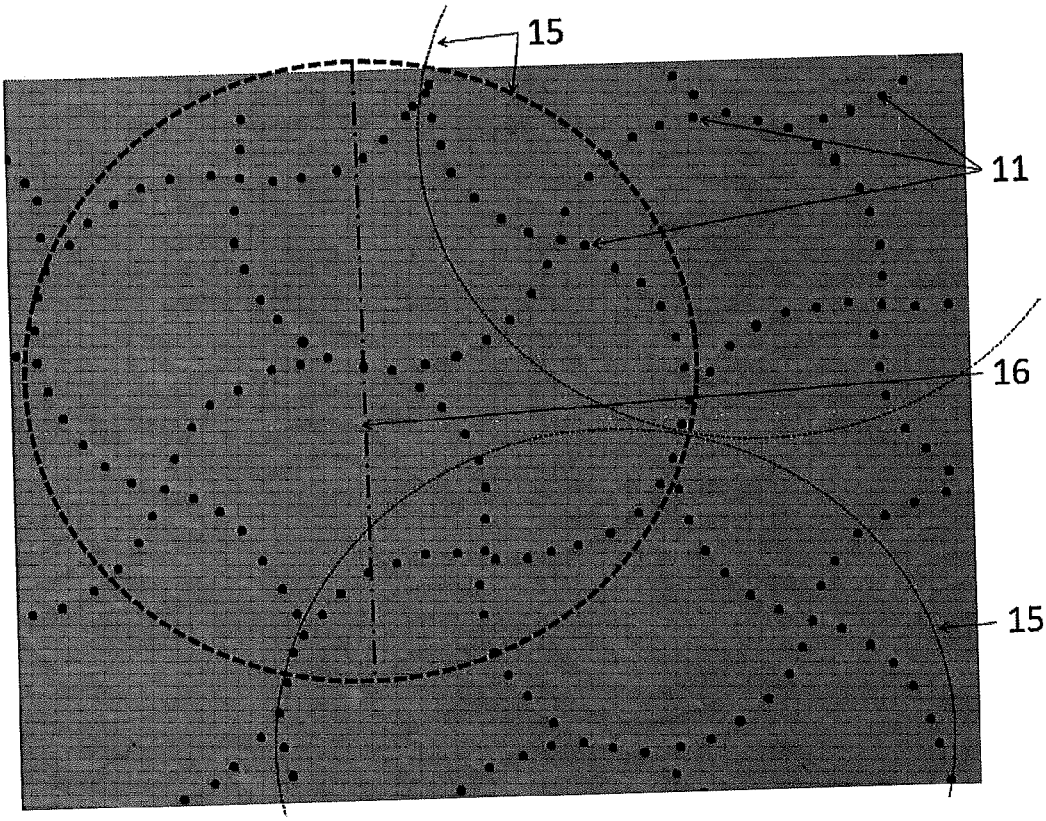
Fig.11-iv

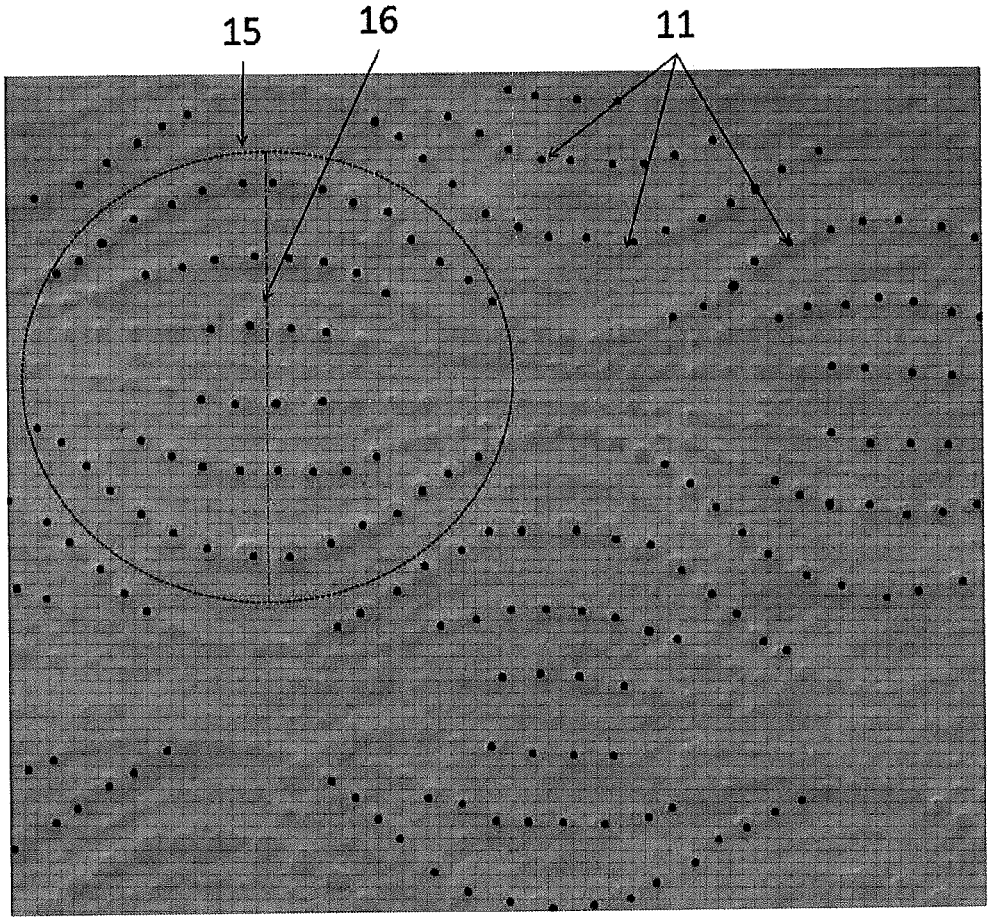
Fig.11-v

NONWOVEN WEB COMPRISING THERMALLY FUSIBLE FIBERS AND BONDING IMPRESSIONS FORMING A PATTERN

CROSS-REFERENCE TO RELATED APPLICATIONS

This application is a submission under 35 U.S.C. § 371 of International Application No. PCT/CZ2017/050020, filed May 2, 2017, which claims priority to Czech Republic Application No. PV2016-250, filed May 2, 2016, the disclosures of which are hereby expressly incorporated by reference herein in their entireties.

Field of the Invention

The present invention relates to a nonwoven web exhibiting improved characteristics especially bulkiness and softness perceived by an end user. The nonwoven web of this type is intended predominantly for use in a sanitary industry particularly as a component of disposable hygienic products, but it can be used anywhere, where its improved characteristics are desired, such as in the field of personal devices or pads in medicine, or for example, for production of cleansing aids such as dish towels or dust cloths.

BACKGROUND OF THE INVENTION

It is well known in the art that the final properties of thermally bonded nonwoven webs can be significantly influenced by an appropriate pattern of bonding points or bonding impressions as well as by the total bond area, and their arrangement in the plane such as in a certain pattern. By selecting appropriate parameters for the pattern, it is possible with the use of the same input material to, for example, produce both a strong compact web resistant against rubbing, as well as a bulky web with an increased softness. There are several methods known in the art of how to achieve particularly improved softness and an improved handle of the final material.

There are well known nonwoven webs known in the art having sophisticated shapes of the bonding points, which provide both desirable combination of easily measurable properties, such as tensile strength, extensibility, necking (narrowing of the nonwoven web in the transverse direction when tensioned in the longitudinal direction), abrasion resistance, high thickness or bulkiness of the material, and subjectively evaluated properties, such as softness and pleasant handling perception.

Various approaches to a shape of bond areas and their arrangement on the surface of a nonwoven web are described, for example, in two patent applications of PEGS NONWOVENS s.r.o. The earlier one, WO2009021473, describes an application of straight bonding impressions having a shape of short lines oriented in MD direction (in the direction of the machine movement). The newer one, WO2012130414, describes bonding shapes containing convex and concave parts and their arrangement in the plane, which leads to reaching of high softness and bulkiness of the web. On the basis of this document a material having a standard handle intended for use in comparative examples was made.

Various patent applications are concerned with an importance of individual parts of the bonding pattern. For instance, the patent U.S. Pat. No. 5,964,742 of Kimberly Clark is concerned with the importance of the bonding impressions and non-bonded fibres among them. The patent U.S. Pat. No. 6,610,390 of First Quality Nonwovens deals, for instance, with the arrangement of the bond areas and points out the importance of the individual shapes of the bond areas orientation on the surface of the nonwoven web.

It is known in the art to use relatively small bond areas with a closed shape, where also above mentioned documents belong, and to use continual bond areas enclosing non-bonded parts. For instance, the patent application U.S. Pat. No. 5,667,625 of Kimberly Clark describes a bond area having a honeycomb like shape.

So called 3D gravures are also known in the art, wherein a pair of engraved bonding rollers is used which is able to interconnect the planar layer of fibres and at the same time to form it significantly in such a way that the thickness of the resulting product is higher than the thickness of the original fibre layer itself. Various examples are described for instance in the documents US2003203691, U.S. Pat. Nos. 4,333,979 or 5,575,874 of Kimberly Clark Comp.

Means for personal use, such as hygienic absorption products, are evaluated unwittingly by end users in general population. Their subjective perception of the used nonwoven web need not always correlate with the results of measurement in the laboratory, and it may influence significantly a future choice of the product by the user. The softness evaluation is influenced by the appearance of the nonwoven web, for example, if the evaluator expects a soft perception on the basis of the appearance (including print, for example), it is probable that the evaluation of the web under consideration will be better than in case when the visual support is missing. The visual impression of softness may be affected by a variety of features and properties, including but not limited to colour, opacity, light reflectivity, refractivity or absorption, as well as to the handle, which in turn may be impacted by apparent or measurable thickness, fibre size and density, and macroscopic physical surface structure including a system of the bonding impressions.

The importance of the final material appearance becomes already evident also in patent applications appearing recently. For example, the patent application WO2015047924 of Proctor and Gamble describes a product with detailed and highly structured arrangement of the bond areas. The total bond areas structure is inhomogeneous, consists of shapes of different sizes, and the structure containing at least one design element, which is not repeated in a square measuring 100×100 mm, and the distance between the bond areas is not longer than 5 mm.

The task to improve perception of the nonwoven web by the end user becomes still more difficult if it is necessary to keep concurrently the other parameters of the nonwoven web, such as tensile strength, extensibility, abrasion resistance, etc. Also the long-term trend to reduce the basis weight of nonwoven webs is limiting, because as a consequence of such reduction the number of fibres per unit surface area participating in the thickness of the soft structure and opacity of the web, is decreased.

SUMMARY OF THE INVENTION

The above described drawbacks of the prior art are eliminated to a large degree by a nonwoven web comprising heat bondable fibres and comprising bonding impressions that form a pattern repeated in the machine direction, wherein the bonding impressions include:

a. a system of basic bonding impressions which are arranged to create visually primary patterns and an area of each basic impression is at least 1 $mm^2$, and b. a system of auxiliary bonding impressions having the area smaller than 1 $mm^2$, c. and wherein a sum of bonding areas of the individual auxiliary bonding impressions accounts for at least 30% of a total bonding area.

In general, it is advantageous, when the area of the individual basic bonding impressions is by at least 20%, preferably by at least 40%, more preferably by at least 60%, even more preferably by at least 80%, even more preferably by at least 100%, even more preferably by at least 150%, even more preferably by at least 200%, advantageously by at least 300% larger than the individual area of the largest auxiliary bonding impression.

In general, it is advantageous, when the sum of the bonding areas of the individual auxiliary bonding impressions forms at least 10%, preferably at least 20%, more preferably at least 25%, advantageously at least 30% of the whole bonding surface area.

In general, it is advantageous, when the sum of the bonding areas of the individual auxiliary bonding impressions forms at most 70%, preferably at most 65%, more preferably at most 60%, advantageously at most 50% of the whole bonding surface area.

In general, it is advantageous, when the individual basic bonding impressions have a surface area, the width of which is at least 0.6 mm.

In general, it is advantageous, when the size of the individual visually primary patterns, represented by the diameter of a circumscribed circle, is at the most 100 mm.

In general, it is advantageous, when individual visually primary patterns are arranged so that their spacing is at least three times, preferably at least five times, advantageously at least ten times longer than the shortest distance between two adjacent basic bonding impressions.

In general, it is advantageous, when the individual visually primary patterns directly follow each other.

In general, it is advantageous, when the system of the basic bonding impressions forms a continuous structure created by substantially parallel lines, and that the longest distance between these substantially parallel lines is at most 40 mm, preferably at most 35 mm, more preferably at most 30 mm, even more preferably at most 25 mm, advantageously at most 20 mm.

In general, it is advantageous, when the auxiliary bonding impressions are arranged homogenously, i.e. with even spacing, on at least a part of the repeated pattern area.

In general, it is advantageous, when the auxiliary bonding impressions are arranged to form visually secondary patterns on at least a part of the repeated pattern area.

In general, it is advantageous, when the basis weight of the nonwoven web is at most 50 $g/m^2$, preferably at most 40 $g/m^2$, more preferably at most 30 $g/m^2$, advantageously at most 26 $g/m^2$.

In general, it is advantageous, when the nonwoven web comprises individual substantially continuous filaments.

In general, it is advantageous, when the nonwoven web comprises nonwoven mono-component fibers or multi-component, preferably bi-component fibers, wherein at least a part of the bi-component fibers are sheath/core or side/side fibers.

In general, it is advantageous, when at least some of the fibers comprise polyolefins.

In general, it is advantageous, when at least at least some of the fibres comprise materials selected from the group consisting of polypropylene, polyethylene, co-polymers, aliphatic polyesters, thermoplastic polysaccharides, other biopolymers or mixtures thereof, dyes, or additives altering surface properties of the material.

In general, it is advantageous, when at least some of the fibers comprise materials selected from a group consisting of polypropylene, polyethylene, polyethylene-terephthalate (PET), polylactic acid (PLA).

In general, it is advantageous, when the nonwoven web is a spun- laid type nonwoven web comprising predominantly spunbond fibres, comprising at least 80%, preferably at least 85%, more preferably 90%, advantageously at least 95% of polypropylene.

In general, it is advantageous, when at least one side of the nonwoven web is abrasion resistant to such a degree that abrasion test with 80 revolutions shows at most degree 3, preferably at most degree 2.5, advantageously at most degree 2 as an average of 10 measurements.

In general, it is advantageous, when the nonwoven web has volume mass at most 75 $kg/m^3$, preferably at most 70 $kg/m^3$, more preferably 65 $kg/m^3$, advantageously 60 $kg/m^3$.

In general, it is advantageous, when at least some of the fibres comprise materials selected from the group consisting of aliphatic homopolymers and/or copolymers thereof, aliphatic polyesters and/or copolymers thereof, biopolymers or mixtures of these materials, dyes, or additives altering surface properties of the material.

A "batt" is used herein to refer to fibre materials prior to being bonded to each other. A "batt" comprises individual fibres, which are usually unbonded to each other, although a certain amount of pre-bonding between fibres may be performed, and this pre-bonding may occur during or shortly after the lay-down of fibres in a spun-melt process, for example. This pre-bonding, however, still permits a substantial number of the fibres to be freely movable such that they can be repositioned. A "batt" may comprise several layers, resulting by depositing fibres from several spinning heads in a spun-melt process, and distributions of a fibre diameter thickness and a porosity in the "sub layers" laid-down from individual heads do not differ significantly. Adjacent layers of fibres need not be separated from each other by sharp transition, individual layers may blend partly in the area around the boundary.

"Fibre" and "filament" are used interchangeably.

"Fibre diameter" is expressed in SI length units-micrometers (μm) or nanometres (nm).

"Fibre diameter" or "fibre thickness" are interchangeable for the purpose of this document. In case when fibres do not have a circular cross-section, a fibre diameter, which corresponds to an equivalent fibre with a circular cross-section is taken into consideration. The terms "grams of fibre per 9000 m" (denier or den) or "grams of fibre per 10000 m" (dTex) are used to describe the fineness or coarseness of fibres.

"Mono-component fibre" refers to a fibre formed of a single polymer component or a single blend of polymer components, as distinguished from bi-component or multi-component fibre.

"Mixture" or "blend" refers herein typically to polymer materials that are included in a fibre. When, for example, multiple polymers are mixed together. Additives of other substances, typically in small amounts (for example dyes, process additives, additives altering surface properties, etc.) are not excluded. The blend can be used both in mono-component fibres, and as a component of a bi-component or multi-component fibre.

"Bi-component fibre" refers to a fibre, the cross-section of which comprises two discrete polymer components, two discrete blends of polymer components, or one discrete polymer component and one discrete blend of polymer components. "Bi-component fibre" is encompassed within the term "multi-component fibre". A "bi-component fibre" may have an overall cross-section divided into two or more subsections of the differing components of any shape or arrangement, including, for example, coaxial subsections, core-and-sheath subsections, side-by-side subsections, "segmented pie", etc. The term "main component" refers to the component, the part by weight of which in the fibre is major. The term "C/S 70/30" describes bi-component fibre of core-and-sheath type, where the core corresponds to 70% by weight and the sheath corresponds to 30% by weight of the fibre.

A "nonwoven" is a manufactured sheet or web of directionally or randomly oriented fibres which are first formed into a batt and then consolidated and bonded together by friction, cohesion, adhesion or one or more patterns of bonds and bonding impressions created through localized compression and/or application of pressure, heat, ultrasonic, or heating energy, or a combination thereof. The term does not include fabrics which are woven, knitted, or stitch-bonded with yarns or filaments. The fibres may be of natural or man-made origin and may be staple or continuous filaments or be formed in situ. Commercially available fibres have diameters ranging from about 0.0005 mm to about 0.25 mm and they come in several different forms: short fibres (known as staple, or chopped), continuous single fibres (filaments or monofilaments), untwisted bundles of continuous filaments (tow), and twisted bundles of continuous filaments (yarn). Nonwoven fabrics can be formed by many processes including but not limited to melt-blowing, spun-bonding, spun-melting, solvent spinning, electro-spinning, carding, film fibrillation, melt-film fibrillation, air-laying, dry-laying, wet-laying with staple fibres and combinations of these processes as known in the art. The basis weight of nonwoven fabrics is usually expressed in grams per square meter (gsm).

"Hygienic absorbent article" refers herein to devices or aids that absorb and contain body exudates, and, more specifically, refers to devices or aids that are placed against or in proximity to the body of the wearer to absorb and contain the various exudates discharged from the body. Absorbent articles may include disposable diapers, training pants, underwear, and adult incontinence undergarments and pads, feminine hygiene pads, breast pads, care mats, bibs, wound dressing products and the like. As used herein, the term "exudates" includes, but is not limited to, urine, blood, vaginal discharges, breast milk, sweat and faecal matter.

"Bond area percentage" of nonwoven fabric represents a ratio of an area occupied by bonding impressions to a total surface of a nonwoven fabric expressed as percentage and measured according to the Bond Area Percentage Method set forth herein.

"Bonding roller", "calender roller" and "roller" are used interchangeably hereinafter.

A "bonding impression" in a nonwoven web is the surface structure created by the impression of a bonding protrusion on a calender roller into a nonwoven web. A bonding impression is a location of deformed, intermeshed or entangled, and melted or thermally fused, materials from fibres superimposed and compressed in a z-direction beneath the bonding protrusion, which form a bond or a bonding area. The individual bonds may be connected in the nonwoven structure by loose fibres between them. The shape and size of the bonding impression approximately corresponds to the shape and size of the bonding surface of a bonding protrusion on the calender roller. "Basic bonding impression" is a part of a visually primary pattern. "Auxiliary bonding impression" may create a visually secondary pattern. Both types of the impressions create together a complete pattern on a nonwoven web. For the purpose of this document a "bonding impression thickness" is understood to mean a width of a bonding impression area in a nonwoven web plane.

With respect to the making of a nonwoven web material and the nonwoven web material itself, "cross direction" (CD) refers to the direction along the web material substantially perpendicular to the direction of forward travel of the web material through the manufacturing line in which the web material is manufactured. With respect to a batt moving through the nip of a pair of calender rollers to form a bonded nonwoven web, the cross direction is perpendicular to the direction of movement through the nip, and parallel to the nip.

With respect to the making of a nonwoven web material and the nonwoven web material itself, "machine direction" (MD) refers to the direction along the web material substantially parallel to the direction of forward travel of the web material through manufacturing line in which the web material is manufactured. With respect to a nonwoven batt moving through the nip of a pair of calender rollers to form a bonded nonwoven web, the machine direction is parallel to the direction of movement through the nip, and perpendicular to the nip.

"Length" or a form thereof, with respect to the diaper, feminine hygiene pad or training pant, refers to a dimension measured along a direction parallel to the longitudinal axis of a product straightened flat.

A "bonding protrusion" or "protrusion" is a feature of a bonding roller at its radially outermost portion, surrounded by recessed areas. Relative to the rotational axis of the bonding roller, a bonding protrusion has a radially outermost bonding surface with a bonding surface shape and a defined bonding shape area, which generally lies along an outer cylindrical surface with a substantially constant radius and thus a constant distance from the bonding roller rotational axis; however, protrusions having bonding surfaces of discrete and separate shapes are often small enough relative to the radius of the bonding roller that the bonding surface may appear flat/planar. The bonding surface shape area is closely approximated by a planar area of the same shape. A bonding protrusion may have sides that are perpendicular to the bonding surface, although usually the sides have an angle slope, such that the cross section of the base of a bonding protrusion is larger than its bonding surface. A plurality of bonding protrusions may be arranged on a calender roller in a pattern. The plurality of bonding protrusions has a bonding area per unit surface area of the outer cylindrical surface which can be expressed as a percentage, in particular as the ratio of the combined total of the bonding shape areas of all the protrusions on the roller, to the total surface area of the roller or the area of its circumferential surface.

BRIEF DESCRIPTION OF THE DRAWINGS

The invention will be described in more detail in the following description by means of some exemplary embodiments and with reference to the appended drawings, in which:

FIG. 11 shows examples of determination of one visually primary pattern and its circumscribed circle i. Depiction of the pattern A on a nonwoven web and marking of basic bond impressions ii. Depiction of the pattern E on a nonwoven web and marking of basic bond impressions iii. Depiction of the pattern E on a drawing and marking of basic bonding impressions iv. Depiction of the pattern D on a nonwoven web and marking of basic bond impressions v. Depiction of the pattern F on a nonwoven web and marking of basic bond impressions

DETAILED DESCRIPTION OF THE INVENTION

Figure 1:
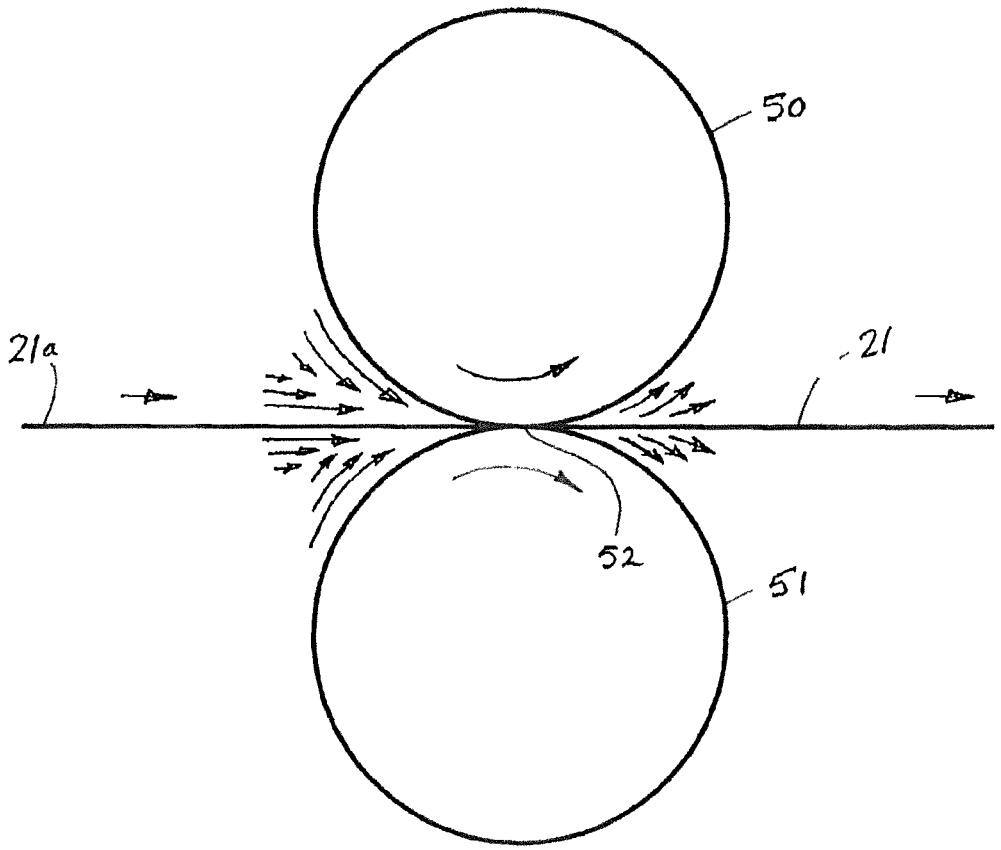
FIG. 1 shows a principal of bonding by means of a pair of calender rollers.

As mentioned above, an overall valuation of the product properties by an end user is significantly influenced also by a visual appearance of the product. In general, a structure of relatively small bonding areas repeated with relatively small spacing on a large surface merge for an eye of an observer into a seamless mass. If we enlarge the bonding points and their spacing so that they may be distinct enough and the observer eye realizes a specific shape, we will face many technological problems. For example, the spacing of the bonding points will be too large and will not ensure sufficient strength of the material. When, for example, considering large pictorial objects and an average size of diaper or feminine hygienic pad, with respect to a support of the design it is desirable to have at least 3, preferably at least 5, preferably at least 7, more preferably at least 9, best at least 11 large objects on one product. For the same products, with respect to a support of the design it is advantageous to have at most 30, preferably at most 26, preferably at most 20, more preferably at most 17, advantageously at most 14 complete large objects on the square area 100×100 mm.

The nonwoven web according to the invention includes a system of basic bonding impressions 11 creating visually primary pattern 10, which is made up by one or more basic bonding impressions 11 creating together one design structure(=visually primary pattern 10). The basic bonding impressions 11, which create one visually primary pattern 10, may have various size, shape as well as an orientation in the nonwoven web surface.

The system of the basic bonding impressions 11 consists of one or more bonding impressions, the area of each of these basic impressions 11 being at least 0.3 $mm^2$, preferably at least 0.4 $mm^2$, preferably at least 0.5 $mm^2$, preferably at least 0.7 $mm^2$, preferably at least 1 $mm^2$.

For the solution of the invention it is advantageous, if a shape of the basic bonding impression 11 has a thickness of at least 0.4 mm, preferably 0.5 mm, advantageously 0.6 mm.

In the industry the use of small impressions of various shapes is known, which impressions give the impression of another larger structure (main visual pattern). For example, it is possible to give the impression of a woven textile by a suitable combination of short lines perpendicular to each other (for example, patent application EP1279348 of Unitica), or it is possible to give the impression of knitted fabric by a suitable combination of the bonding impressions with a shape of small arches. In case of a solution according to the present invention it is desirable to give the impression of large objects, which seemingly project from the textile surface and may give the visual impression of distinctive 3D structure, which, however, in fact is not contained in the nonwoven web.

Figure 2:
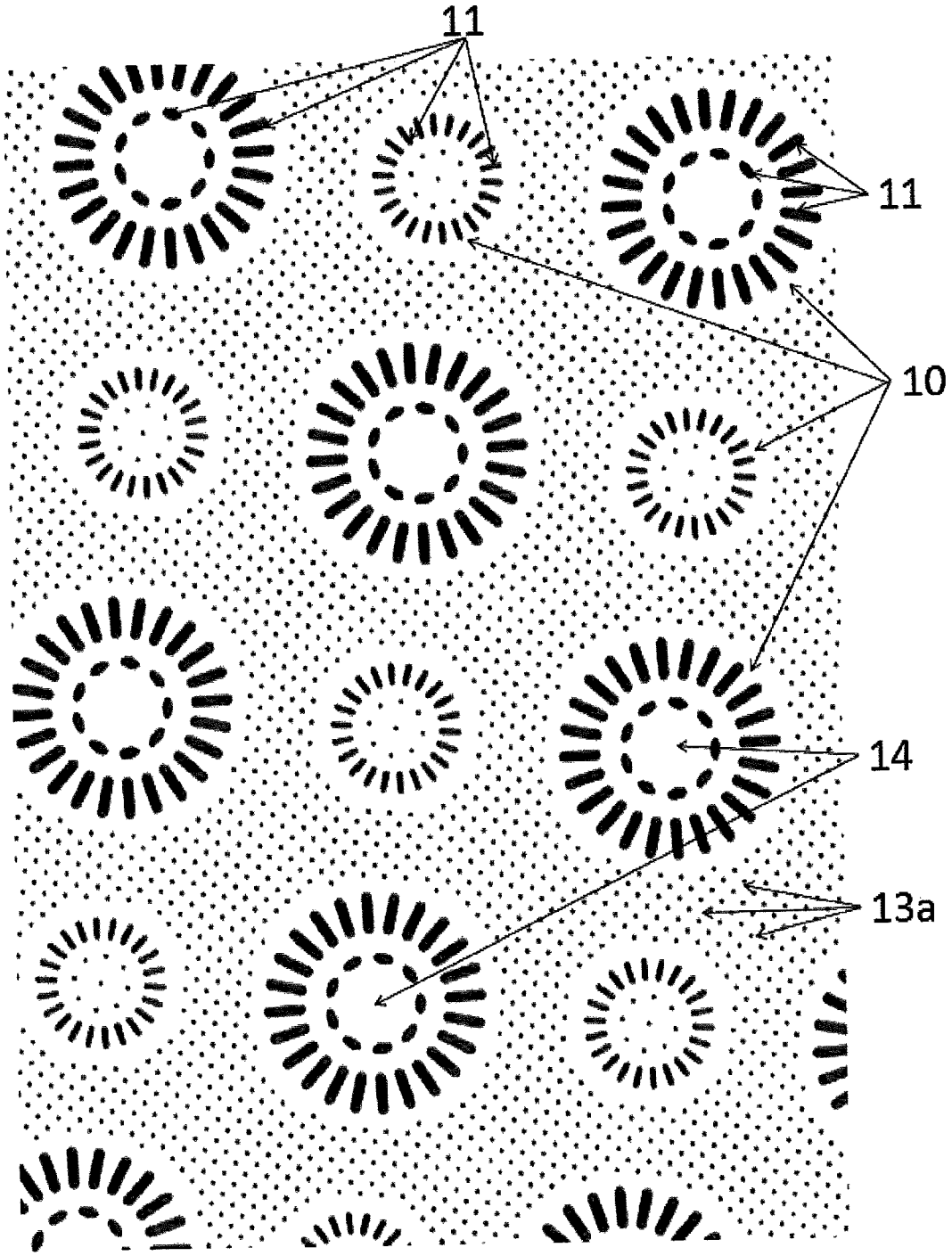
FIG. 2 shows an arrangement of bonding impressions according to the invention—pattern A.

The visually primary patterns 10 may be arranged on a surface in such a way, that their spacing (the distance from one pattern to another one) is at least three times, preferably at least five times, advantageously at least ten times longer than the shortest distance between two adjacent basic bonding impressions 11 creating single visually primary pattern 10. An example of a possible arrangement is depicted in FIG. 2 (pattern A). The use of the nonwoven web with the mentioned arrangement of the visually primary patterns 10 on a hygienic absorbent product, on, for example, a part intended for a liquid distribution inward the product, may give the impression of a sink, through which a body fluid is drained from a skin faster.

In another solution the visually primary patterns 10 may be arranged so that they are immediately contiguous, or they follow each other directly and this way create the main visual pattern. For example (FIG. 6—pattern E), it may give the impression of a knitted pattern, which is bulky, embossed, soft and pleasant to touch. Or, for example (FIG. 5—pattern D), it may give the impression of a quilted textile fabric and so arouse an expectation of a softness and fullness of areas between lines of apparent quilting threads. In both mentioned examples, the system of auxiliary bonding impressions 13, described hereinafter, significantly brings the appearance of the main visual pattern 10 to completeness.

Figure 5:
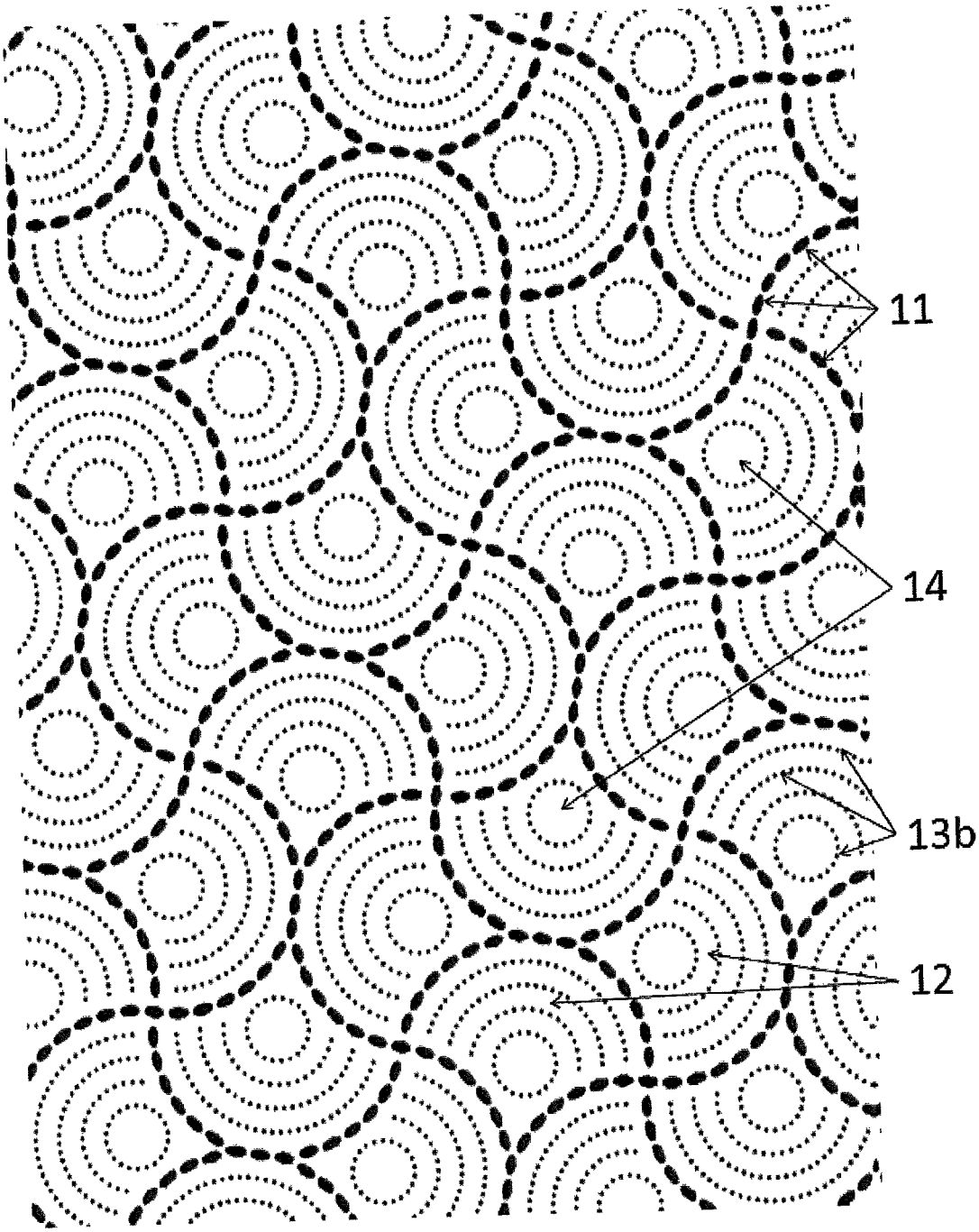
FIG. 5 shows an arrangement of bonding impressions according to the invention—pattern D.
Figure 6:
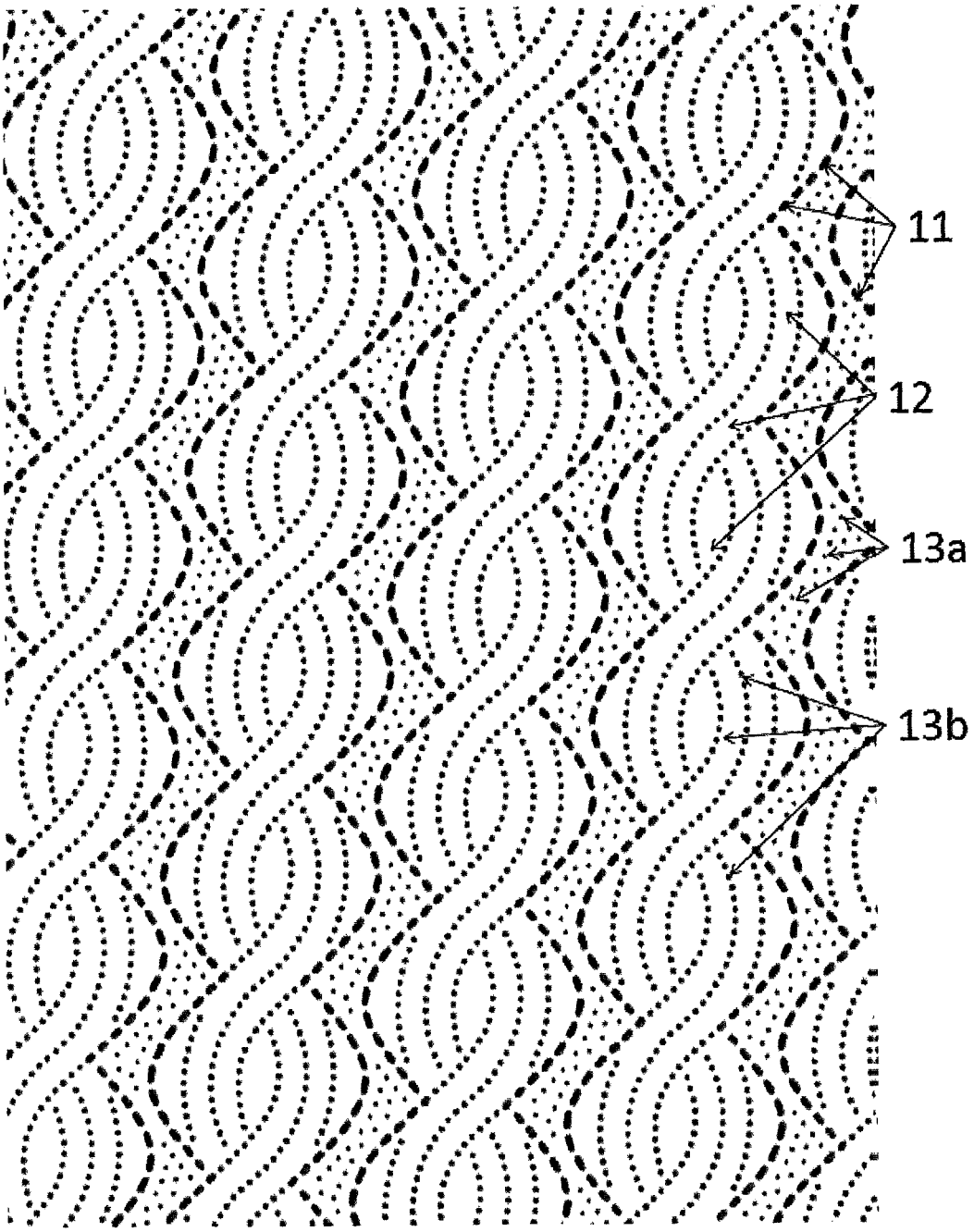
FIG. 6 shows an arrangement of bonding impressions according to the invention—pattern E.
Figure 7:
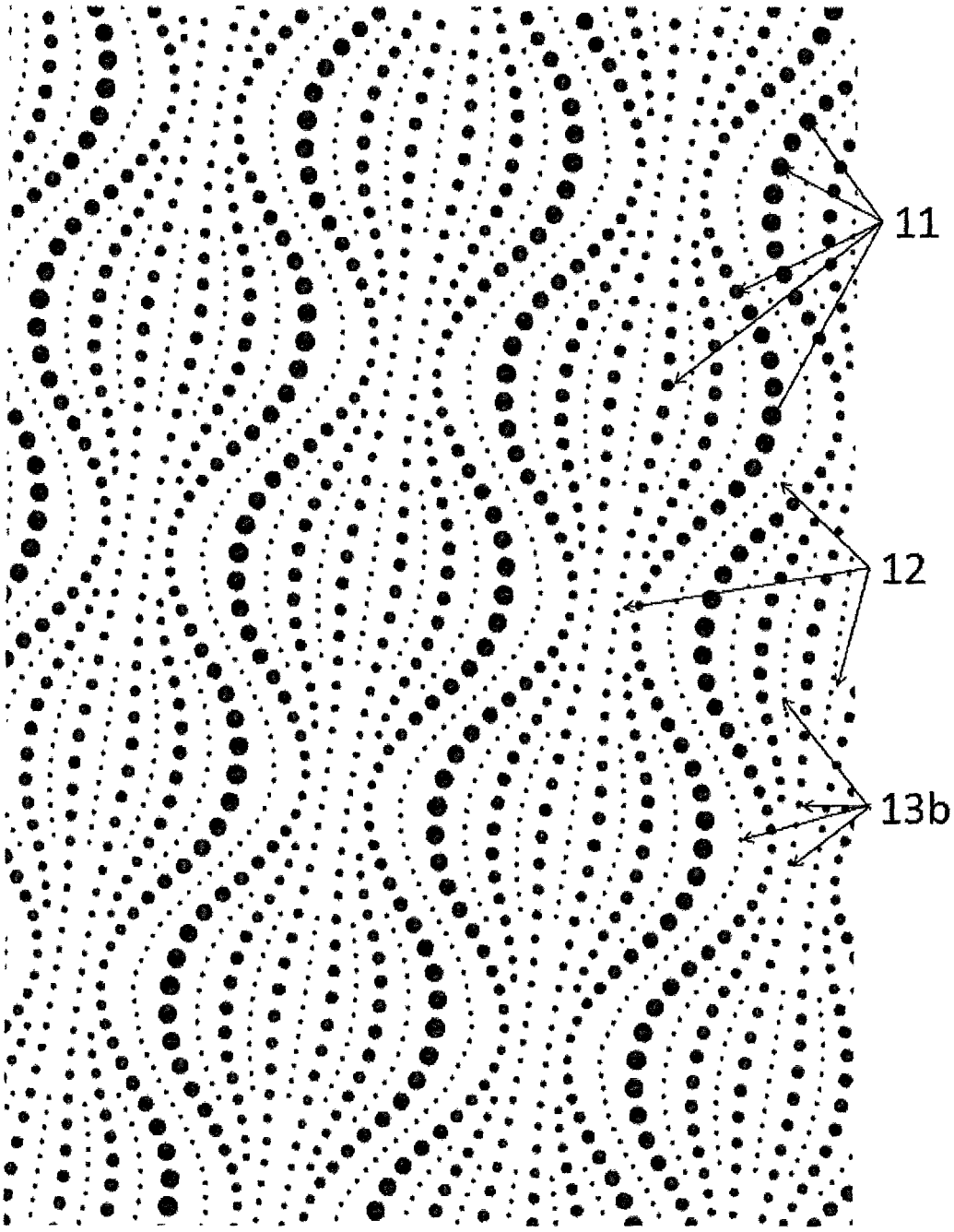
FIG. 7 shows an arrangement of bonding impressions according to the invention—pattern F.

In case the visually primary patterns 10 follow each other directly, determination of the size and shape of a single visually primary pattern 10 may be complicated. In such a case, one visually primary pattern 10 is comprised of the smallest repeated system of basic bonding impressions 11. The complete pattern comprised of the visually primary patterns 10 following each other directly, can be created by linear shifting of one visually primary pattern 10, without it being rotated. Examples of individual visually primary patterns 10 following each other directly are depicted in FIG. 5 to FIG. 7—patterns D, E, F.

For a solution of the invention it is advantageous, if an overall size of the visually primary pattern 10, expressed by a diameter of a circle circumscribed it, is at most 100 mm, preferably at most 80 mm, more preferably at most 60 mm, advantageously at most 50 mm.

In another solution the visually primary patterns 10 may be arranged so that they follow each other directly and thereby create the main visual pattern. For example, the pattern E contains a system of the basic bonding impressions 11 arranged in continuous lines of couples of arches, the arches in each couple being opposite to each other.

For the type of pattern, where the system of the basic bonding impressions 10 forms a continuous structure in a single direction, it may be advantageous for the longest distance between the lines, substantially parallel with each other, to be at least 8 mm, preferably at least 10 mm, preferably at least 12 mm, more preferably at least 14 mm, advantageously at least 16 mm. For the solution according to the present invention it is not important in which direction the substantially parallel lines are orientated (for example MD, CD, inclined).

For the type of pattern, where the system of the basic bonding impressions 11 form a continuous structure in a single direction, it may be advantageous for the longest distance between the lines, substantially parallel with each other, to be at most 40 mm, preferably at most 35 mm, preferably at most 30 mm, more preferably at most 25 mm, advantageously at most 20 mm. For the solution according to the invention it is not important in which direction the substantially parallel lines are orientated (for example MD, CD, inclined).

In another solution the visually primary patterns 10 can be arranged so that they follow each other directly and so create the main visual pattern. For example the pattern D contains a system of the basic bonding impressions 11 arranged in lines periodically crossing each other, which lines can give an observer the impression of, for example, waved net.

For the pattern type, where the system of the basic bonding impressions 11 creates a continuous structure both in CD direction and in MD direction, it may be advantageous for the surface areas, delimited by the system of the basic bonding impressions 11, to have the size of at least 100 $mm^2$, preferably at least 150 $mm^2$, advantageously at least 200 $mm^2$.

In another solution the visually primary patterns 10 can be arranged so that they follow each other directly and so form the main visual pattern. The basic bonding impressions 11 system can be arranged, for example, so that the individual basic bonding impressions 11 form relatively loosened structure. For example, the pattern F contains a system of the basic bonding impressions 11 arranged in loosened lines, the size of the basic bonding impressions 11 in the system changing continuously in dependence on their position.

Figure 12:
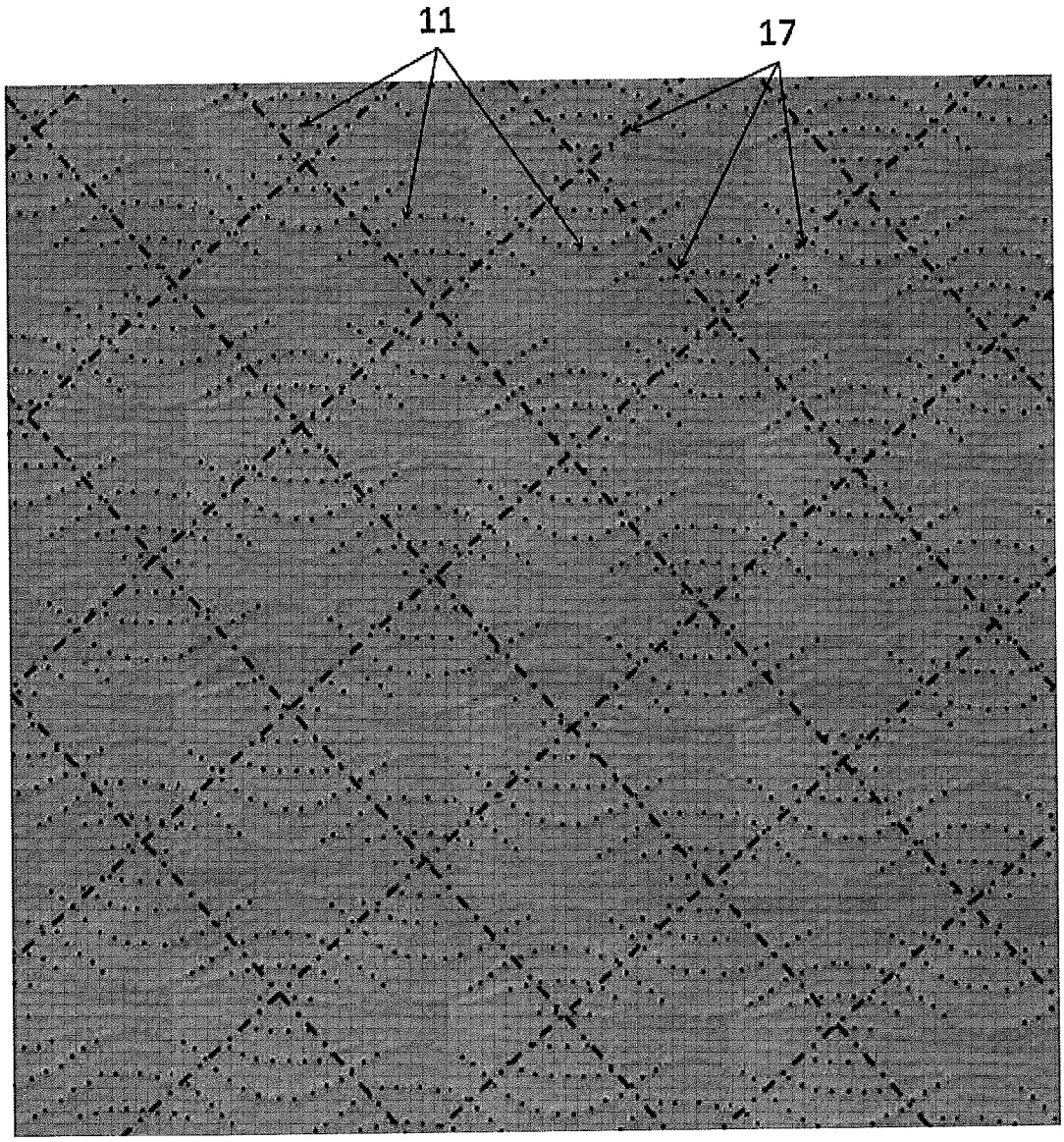
FIG. 12 shows depiction of the pattern F on a nonwoven web with marking of basic bonding impressions and substantially parallel virtual lines.

For the pattern type, where the system of the basic bonding impressions 11 creates a continuous structure without distinct continuous lines, it may be advantageous to intersperse this structure with imaginary parallel lines 17 so that these lines may substantially follow the direction of regular structures in the main pattern (for example, in FIG. 12 it is depicted for pattern D). For the solution according to the present invention it may be advantageous for the longest distance between the imaginary lines 17 substantially parallel to each other to be at least 8 mm, preferably at least 10 mm, preferably at least 12 mm, more preferably at least 14 mm, advantageously at least 16 mm. For the solution according to the present invention it may be advantageous for the longest distance between the imaginary lines 17 substantially parallel to each other to be at most 40 mm, preferably at most 35 mm, preferably at most 30 mm, more preferably at most 25 mm, advantageously at most 20 mm. For the solution according to the present invention it is not important in which direction the substantially parallel lines are orientated (for example MD, CD, inclined).

The above mentioned drawback, caused by necessity to space the visually primary patterns 10 sufficiently far from each other, or by necessity of sufficiently large areas inside of the visually primary patterns 10, is eliminated by the solution according to the present invention using a system of auxiliary bonding impressions 13, which can give the impression of, for example, "a background" or "finer" or "more delicate" structure when compared with the visually primary pattern 10.

In the industry, gravures are known, which make use of small bonding impressions only (for example, in a shape of dots) or thin lines (which can be also created by the small impressions placed substantially side by side). Individual impressions may be spaced homogeneously (spacing of the individual bonding impressions is substantially constant), or may create their own patterns. Examples of the gravures are given in, for example, the patent application U.S. Pat. No. 4,753,834 of Kimberly Clark Comp. or in the application US2012315440 applied by Ichikawa Karo. Resulting properties of such nonwoven webs depend on the size and shape of the bonding impressions and their arrangement in space. Generally, the probability is that use of the small bonding impressions, with a common total bonding area, will result in a very uniformly looking nonwoven web with increased flexibility and softness at the cost of decreased tensile strength, especially in CD direction.

A nonwoven web according to the present invention contains a system of the auxiliary bonding impressions 13, each individual auxiliary bonding impression 13 having the area of at most 1 $mm^2$, preferably at most 0.7 $mm^2$, preferably at most 0.5 $mm^2$, preferably at most 0.4 $mm^2$, more preferably at most 0.3 $mm^2$, advantageously at most 0.2 $mm^2$.

A nonwoven web according to the present invention contains advantageously a system of the auxiliary bonding impressions 13, each individual auxiliary bonding impression 13 having a shape of circle with a diameter of at most 1.1 mm, preferably at most 0.9 mm, preferably at most 0.8 mm, preferably at most 0.7 mm, more preferably at most 0.6 mm, advantageously at most 0.5 mm.

In dependence on the technological procedure used and on conditions of the nonwoven web bonding, fed polymer or multiple polymers used, and thickness and thermal capacity of the bonded fibres layer, a small size of the auxiliary bonding impressions 13 may show up specifically in some solutions according to the present invention. Person skilled in the arts realizes readily which combinations of conditions can result in the effect described hereinafter.

In specific cases the small size of the auxiliary bonding impressions 13 can have the following consequence: the bonding impression area does not catch so many fibres like that of the larger basic bonding impressions 11 (creating, for example, visually primary pattern 10), and at the same time the fibre layer could not be bonded through its full thickness by these small auxiliary bonding impressions 13 in contrast to the basic bonding impressions 11. Fibres of the nonwoven web may then be more consolidated from the side of contact with engraved roller. Person skilled in the art can easily recognize which side of the nonwoven web is so called plain side and where the so called "gravure" is. Person skilled in the art can also realize that this effect can be observed better on a nonwoven web produced of more material layers (for example, from more manufacturing heads following one after another), where fibres in one layer may be, for example, interlocked with each other more than fibres of the superimposed layers.

Higher degree of a consolidation from one side of the nonwoven web may have an impact on, for example, results of abrasion measuring made on one side and on the other side of the nonwoven web. The abrasion from the plain side of the nonwoven web can be considerably higher than the abrasion from the side of the gravure. Person skilled in the art can realize that when designing a hygienic absorbent product, the surface layers of the product are generally used in such a way, that one side of the nonwoven web is adjacent to a user and the other one to the inside of the hygienic product. That way the side with higher resistance against rubbing can be adjacent to the user and the side with lower resistance can be "concealed" inside the product. For example, the orientation of the "gravure" side towards a user may be advantageous even from the point of view of a design and overall perception of the product by the user.

Thermally bonded nonwoven web with a pattern on it, which pattern secures a consolidation of fibre layer into the nonwoven web, and contains a system of basic bonding impressions 11 creating a visually primary pattern 10 and a system of auxiliary bonding impressions 13, is a subject matter of the present invention. It was surprisingly found out that with a suitable combination of the basic bonding impressions 11 with the smaller auxiliary bonding impressions 13 unexpectedly good resulting properties can be reached. With a suitable arrangement of both types of the impressions 11, 13 a synergy effect occurs and the resulting properties of the nonwoven web are comparable with, for example, soft bulky materials described in the patent application WO2012130414 of PEGAS NONWOVENS s.r.o. Person skilled in the art easily realizes that the use of the auxiliary bonding impressions 13 among large objects significantly reduces airflow along convex and suitably inclined bonding protrusions on a calender and thus also reduces a mechanism ensuring a high bulkiness of the textile. For the purpose of comparison the gravure depicted in above mentioned application in FIGS. 6 and 7 (here FIG. 8—pattern G, and FIG. 9—pattern H) was selected as a standard.

For a solution according to the present invention it is advantageous, if the visually primary pattern 10 is combined with the auxiliary bonding impressions 13 in such a way that an area of each basic bonding impression 11 is by at least 20%, preferably by at least 40%, preferably by at least 60%, preferably by at least 80%, preferably by at least 100%, preferably by at least 150%, more preferably by at least 200%. advantageously by at least 300% larger than an individual area of the largest auxiliary bonding impression 13.

For a solution according to the present invention it is advantageous, if the visually primary pattern 10 is combined with a system of the auxiliary bonding impressions 13 on the surface of the nonwoven web in such a way that the sum of bonding areas of individual auxiliary bonding impressions 13 comprises at least 10%, preferably at least 20%, more preferably at least 25%, advantageously at least 30% of the total bonding area.

For a solution according to the present invention it is advantageous, if the visually primary patterns 10 are combined with a system of the auxiliary bonding impressions 13 on the surface of the nonwoven web 21 in such a way that the sum of bonding areas of individual auxiliary bonding impressions 13 comprises at most 70%, preferably at most 65%, even more preferably 60%, advantageously at most 50% of the total bonding area.

For a solution according to the present invention it is advantageous, if the visually primary patterns 10 are combined with a system of the auxiliary bonding impressions 13 on the surface of the nonwoven web in such a way that the sum of bonding areas of individual basic bonding impressions 11 comprises at least 70%, preferably at least 75%, more preferably at least 80%, advantageously at least 90% of the total bonding area.

For a solution according to the present invention it is advantageous, if the visually primary patterns 10 are combined with a system of the auxiliary bonding impressions 13 on the surface of the nonwoven web in such a way that the sum of bonding areas of individual basic bonding impressions 11 comprises at most 50%, preferably at most 40%, more preferably at most 35%, advantageously at most 30% of the total bonding area.

For a solution according to the present invention it may be advantageous, if the visually primary patterns 10 are combined with the system of the auxiliary bonding impressions 13 on the surface of the nonwoven web in such a way that areas among the visually primary patterns 10 and/or areas filling spaces bordered by the system of the basic bonding impressions 11, are substantially filled with the system of the homogenously arranged basic bonding impressions 13. The homogenous arrangement presents arrangement of the bonds substantially with the same distances from each other. For a solution according to the present invention it is advantageous, if the spacing of the auxiliary bonding impressions 13 is at least 0.5 mm, preferably at least 0.8 mm, preferably at least 0.9 mm, more preferably at least 1 mm, advantageously at least 1.1 mm. For a solution according to the present invention it is advantageous, if the spacing of the auxiliary bonding impressions 13 is at most 3 mm, preferably at most 2.5 mm, preferably at most 2 mm, preferably at most 1.8 mm, more preferably at most 1.6 mm, advantageously at most 1.4 mm.

For a solution according to the present invention it may be advantageous, if the distance between the area filled up with the system of the homogenously distributed basic bonding impressions 13 and the visually primary object is at least 1.5 times, preferably at least 1.7 times, more preferably at least twice, advantageously preferably at least 2.5 times longer than the distance between the individual auxiliary bonding impressions 13.

For a solution according to the present invention it may be advantageous, if the continuous area filled with the system of the homogenously distributed auxiliary bonding impressions 13 includes a group of at least 10, preferably at least 15, preferably at least 20, preferably at least 25, more preferably at least 30 auxiliary bonding impressions 13.

For example, if a pattern is comprised of discretely (discontinuously) distributed visually primary patterns 10 (for example, patterns A, B, C), it may be advantageous for a solution according to the present invention for the area, covered by the homogenously distributed auxiliary bonding impressions 13, to comprise at least 40%, preferably at least 50%, more preferably at least 60%, advantageously at least 65% of the repeated pattern area.

For example, if a combination of visually secondary patterns 12 created by auxiliary bonding impressions 13 arranged, for example, in lines collateral with the visually primary patterns 10 (for example patterns D, E, F), is a part of the repeated pattern, it may be advantageous for a solution according to the present invention, for the area, covered by homogenously distributed auxiliary bonding impressions 13, to comprise at most 40%, preferably at most 30%, preferably at most 20%, preferably at most 10%, advantageously to comprise no homogenously distributed auxiliary bonding impressions 13.

For a solution according to the present invention it may be advantageous, if the visually primary patterns 10 are combined with the system of the auxiliary bonding impressions 13 on the surface of the nonwoven web 21 in such a way that areas among the visually primary patterns 10 and/or areas filling spaces bordered by the system of the basic bonding impressions 11, are substantially filled with the system of the homogenously arranged auxiliary bonding impressions 13 arranged so that they form visually secondary patterns 12 (they are arranged, for example, in lines or form clusters).

The auxiliary bonding impressions 13 arrangement in lines presents the distribution of the auxiliary bonding impressions 13 so that the spacing of the auxiliary bonding impressions 13 in direction of the lines is significantly shorter than the distance between adjacent lines. For a solution according to the present invention it may be advantageous if the distance between adjacent auxiliary bonding impressions 13 in a line is at most 2 mm, preferably at most 0.8 mm, preferably at most 1.5 mm, preferably at most 1.2 mm, preferably at most 1.0 mm, preferably at most 0.8 mm, more preferably 0.6 mm, advantageously at most 0.5 mm. For a solution according to the present invention it may be advantageous if the distance between adjacent auxiliary bonding impressions 13 in a line is at least 0.1 mm, preferably at least 0.2 mm, advantageously at least 0.3 mm.

For a solution according to the present invention it may be advantageous, if the visually primary patterns 10 are combined with the system of the auxiliary bonding impressions 13 on the surface of the nonwoven web 21 in such a way that areas among the visually primary patterns 10 and/or areas filling spaces bordered by the system of the basic bonding impressions 11, are substantially filled with the system of the auxiliary bonding impressions 13 forming a visually secondary pattern 12 by their arrangement in lines having shape of curves. For a solution according to the present invention it may be advantageous, if, for example, the individual lines, formed by the auxiliary bonding impressions 13, create parts of circles or ovals. For another solution according to the present invention it may be advantageous, if, for example, the individual lines, formed by the auxiliary bonding impressions 13, are distributed with regular spacing (for example, FIG. 5—pattern D). In another case, it may be advantageous for a solution according to the present invention, that the individual lines, formed by the auxiliary bonding impressions 13, come nearer to each other and again move away from each other regularly. In another case, for a solution according to the present invention, it may be advantageous for the individual lines to touch or cross each other.

For a solution according to the present invention it may be advantageous, if the visually primary patterns 10 are combined with the system of the auxiliary bonding impressions 13 on the surface of the nonwoven web 21 in such a way that areas among the visually primary patterns 10 and/or areas filling spaces bordered by the system of the basic bonding impressions 11, are not filled in the whole area of the repeated pattern uniformly. For a solution according to the present invention it may be advantageous, if, for example, a part of the areas among the visually primary patterns 10, and/or a part of the areas filling the spaces bordered by the system of the basic bonding impressions 11, is created by the system of the homogenously distributed auxiliary bonding impressions 13, and another part is created by the system of the auxiliary bonding impressions 13, which form the visually secondary pattern 12 (for example, the arrangement in lines).

For a solution according to the present invention it is advantageous, if the percentage of the total bonding area, (that is a ratio of the sum of all bonding impressions 11, 13 areas to the total surface of the nonwoven web) is at least 8%, preferably at least 10%, advantageously at least 12%. For a solution according to the present invention it is advantageous, if the percentage of the total bonding area is at most 20%, preferably at most 18%, more preferably at most 16%, advantageously at most 15%.

The combination of the system of the basic bonding impressions 11, forming the visually primary pattern 10, with the system of the auxiliary bonding impressions 13 brings advantages both from the appearance of the nonwoven web point of view, and from the point of view of the resulting properties of them. From an observer point of view, the auxiliary bonding impressions 13 in, for example, homogenous distribution, seen by human eye, can be insufficiently distinct when compared with the visually primary patterns 10, and that way they can create unobtrusive background, from which the visually primary patterns 10 protrude seemingly. With regard to functionality, the auxiliary bonding impressions 13 fulfil the important function of the fibre structure interlocking, compactness and batt cohesion, and ensure a general resistance of the nonwoven web against, for example, abrasion or other way of mechanical damage. Nevertheless, the system of the auxiliary bonding impressions 13, by its character and distribution, does not limit the thickness or bulkiness of the nonwoven web. On the contrary, with a suitable arrangement of the auxiliary bonding impressions 13 system, for example in suitably distributed lines creating the visually secondary patterns 12, they can increase real as well as subjectively perceived thickness of the nonwoven web.

A pattern, securing a consolidation of nonwoven web fibre layer advantageously may contain also free areas, i. e. areas, where the length of fibre between bonding impressions 11, 13 is longer than in other areas. The free areas may be advantageous also from the design point of view where a presence of the area without any bonding impression 11, 13 can highlight a general visual concept. So, it is known in the field, that, for example, loose fibres have generally lower rigidity than the bonding impressions 11, 13 and therefore the nonwoven web with higher share of longer fibre sections between the bonding impressions 11, 13 is assessed as softer and more draping. Generally it is also true that this effect can be achieved at the cost of the material tensile strength decrease especially in CD direction, where the bonding impressions 11, 13 provide strength. Suitably located free areas may also have an influence on the nonwoven web thickness when the fibres between the bonding impressions 11, 13 can "bulge out" into a space and so form three dimensional structure reminding, for example, a small pillow.

A solution according to the present invention can include advantageously free areas, i. e. areas, on which a circle at least 2 mm, preferably at least 3 mm, preferably at least 4 mm, advantageously at least 5 mm in diameter can be placed so that the circle does not contain or intersect any bonding impression 11, 13.

For a solution according to the present invention it is advantageous if the individual areas of the circles, which do not contain or intersect any bonding impression 11,13, follow each other in such a way that the line segment, connecting intersection points of the adjacent circles circumferences, has a length corresponding with at least the radius of the smaller of these circles; and that the total size of the created continuous area covered by the mentioned circles is at least 20 $mm^2$, preferably at least 30 $mm^2$, preferably at least 40 $mm^2$, preferably at least 50 $mm^2$, preferably at least 60 $mm^2$, more preferably at least 80 $mm^2$, advantageously at least 100 $mm^2$. The considered area can be formed by one, two or more partly overlapping circles. For a solution according to the present invention it may be advantageous if an average length of loose fibres forming a free area does not exceed 20 mm, preferably 15 mm, advantageously 10 mm.

A solution according to the present invention can be realized advantageously by means of a thermal bonding of a nonwoven web by a pair of calender rollers. Technological procedure of the thermal bonding of this type includes a step of creating bond among fibres forming a fibre layer, whereat the fibres consolidate to a certain degree and interlink bringing forth a textile and concurrently increasing values of mechanical properties, for example tensile strength, which may be necessary for the material to be able to maintain sufficient structural integrity and dimensional stability in the course of subsequent manufacturing processes and use of the final product. As it is obvious from FIG. 1, a bond forming by calendering can be carried out in such a way that a fibre layer 21*a* passes through a nip of a pair of rotating calender rollers 50, 51, thereby the fibres are compressed and consolidated bringing forth a nonwoven web 21.

One or both calender rollers 50, 51 can be heated so that they support warming, plastic deformation, penetration and/or thermal melting/fusion of superimposed fibres in the process of their being compressed in the pressing nip. The rollers can constitute operational parts of a bonding mechanism, in which they are pressed together with a force of a controlled intensity so as to generate a required compressive force/required pressure in the pressing nip. In some processes a source of ultrasonic energy may be incorporated in the bonding mechanism to enable transmission of ultrasonic vibration into the yarns, thus creating a thermal energy in them, which improves bonding.

A bonding pattern, consisting of bonding protrusions and recessed areas, can be made using machining, etching, engraving or other technique on the circumferential surface of one or both calendering rollers 50, 51, thereupon the bonding pressure, having effect on the fibre layer passing through the pressing nip 52, is concentrated on bonding surfaces of the bonding protrusions, while it is decreased or substantially restricted in the recessed areas. The bonding surfaces have predetermined shapes. As a consequence of this, a nonwoven web 21 with a pattern consisting of bonding impressions 11, 13 among fibres, which form this nonwoven web 21, is formed, whereas the shape of these bonding impressions correspond to the shape of the bonding protrusions arranged in identical pattern on the surface of the calender roller 50, 51. One of the rollers, for example 51 can have a smooth cylindrical surface without any pattern and so it is the pressure or bearing roller, while the other roller 50 can be equipped with the pattern described above, and so it can be the roller creating the bonding pattern in the processed material; the pattern created on the nonwoven web by this combination of rollers will then exactly correspond to the pattern on the mentioned other roller 50. In some cases both rollers 50, 51 can be equipped with patterns, whereas these patterns can be even different. In such a case a combined pattern is created on the nonwoven web by the effect of those patterns. Such a combined pattern is described, for example, in the patent U.S. Pat. No. 5,370,764.

A pattern consisting of repeated bonding protrusions and recessed areas with the relief, which is depicted, for example, in FIGS. 2-10 can be created on the calender roller 50. By the effect of bonding shapes of the bonding protrusions, bonding impressions/points of the same shape are created on the nonwoven web in the calendering process.

The bonding protrusions created on the bonding calender roller 50 will have a height, which can be expressed as a difference between the radius of the outer surface of the roller, passing through the uttermost (bonding) surfaces of the bonding protrusions, and the radius of the calender roller 50 in the recessed areas. This height can be adapted with the aim to minimize a volume of the material, which is necessary to be taken from the roller surface by means of machining or etching in the process of creating desired shapes and desired pattern, concurrently ensuring a sufficient clearance between the calender roller 50, equipped with bonding protrusions, and the opposite calender roller 51 in recessed areas, i.e. the clearance, which is necessary for the fibre layer 21*a* to pass through the pressing nip 52 in the areas, where bonding among fibres is not to be created (i.e. in the areas corresponding with the mentioned recessed areas), and where substantially compressing of the material is not to come about, because reaching of maximum improvement of handle/increasing of measured height of the material is the aim here.

With nonwoven webs, which type and basis weight come under consideration for this purpose, the desired height of the bonding protrusions can be within the range 0.3 mm to 1.0 mm, preferably within the range 0.5 to 0.8 mm, and even within the range 0.6 to 0.7 mm. The bonding protrusions usually have side walls, which are inclined in cross-section view, the section plane being oriented in the height direction.

Nonwoven webs of the type considered here, can be bonded by means of calender, when speed of the production line is higher than 300 m/min or 600 m/min or even 800 m/min, eventually still higher, the speed being dependant on the nonwoven web composition, basis weight of fibres, bonding pattern, device used and selected process variables.

Nonwoven web 21 consolidated by means of calender rollers 50, 51, are always formed by a pattern repeated in direction of the nonwoven web 21 movement (MD). Person skilled in the art easily realizes that the maximum size of the repeated pattern is given by the calender rollers 50, 51 dimensions(a width and a circumference). For the purpose of this document we will consider a repeated pattern created by a quadrangle area, the sides of which are oriented approximately in directions MD and CD of the nonwoven web 21, and by its repeating both in CD and in MD directions the complete bonding matrix of the nonwoven web 21 is created. It is not important for the present invention, if the quadrangle sides orientation departs from CD or MD directions by an angle smaller than 30°, preferably smaller than 25°, preferably smaller than 20°, preferably smaller than 15°, more preferably smaller than 10°, advantageously smaller than 5°.

The manufactured nonwoven web 21 is used subsequently, for example, for production of articles of daily use, such as hygienic absorbtion products, napkins, wipes or protective devices. We can see all these products in common life from the distance of tens centimetres up to units of meters. The design point of view meets the technical point of view. Resulting properties of a nonwoven web manufactured according to the present invention may differ locally. If we should assess, for example, tensile strength of the nonwoven web 21 within the bounds of the visually primary pattern 10 only, it will differ from the tensile strength in the area of, for example, homogenously distributed auxiliary bonding impressions 13 or from the tensile strength in the area of loose fibres. The limitation of the repeated pattern size ensures the necessary degree of the nonwoven web resulting properties homogeneity for expected applications. For a solution according to the present invention it is advantageous, if the pattern is repeated, for example, at least every 250 mm, preferably at least every 150 mm, preferably at least every 100 mm, advantageously at least every 50 mm.

For example, common diaper of size 4 (for children of weight 7 kg to 18 kg) can have a top sheet (upper textile layer) with dimensions 450×150 mm, and thus it is desirable for the pattern repeated on it to appear along its length at least twice, preferably at least three times, more preferably at least five times, advantageously at least nine times. On the contrary, for example, with feminine hygiene pads with a top sheet with dimensions 160×60 cm, it is desirable for the repeated pattern to appear on it along its length at least once, preferably at least twice, advantageously at least three times. For the number mentioned, when repeated more than once, the last repeated pattern need not be depicted complete.

For example, common feminine hygiene pad can contain a top sheet measuring 220×80 mm, and thus it is desirable for the pattern repeated on it to appear along its length at least once, preferably at least twice, more preferably at least three times, advantageously at least four times. For the number mentioned, when repeated more than once, the last repeated pattern need not be depicted complete.

From the design point of view it is desirable for the repeated pattern to be created by various structures, which are distinct from one another sufficiently in order that the individual parts may grab the attention or on the contrary seemingly fuse together creating an impression of distinct 3D structure. From the visual perception point of view it is advantageous if the complete repeated pattern occupies the area at least twice, preferably three times, preferably five times, more preferably eight times, advantageously ten times larger than the circular surface bordered by a circle circumscribed the largest contained visually primary pattern 10. Suitable nonwoven textile materials useful in the present invention include, but are not limited to spun-bond, melt-blown or spun-melt, solvent-spun, electro-spun, carded, film fibrillated, melt-film fibrillated, air-laid, dry-laid, wet-laid staple fibres, and many other nonwoven web materials formed in part or in whole of polymer fibres, as known in the art. A suitable nonwoven web material may also be an SMS material, comprising a spun-bonded, a melt-blown and a further spun-bonded stratum or layer, or any other combination of spun-bonded and melt-blown layers, such as a SMMS or SSMMS etc. Examples include one or more layers of fibres with diameters bellow 1 micrometer (nanofibres and nanofibre layers); which form combined materials called also nonwoven webs of the type SMS, SMNS, SSMNS or SMNMS nonwoven webs (where "N" designates a nanofibre layer). In some examples, permanently hydrophilic nonwovens, and in particular, nonwovens with durably hydrophilic coatings may be desirable. Typically, the suitable nonwoven is air permeable. Typically the suitable nonwoven is water or liquid permeable, but may also be water impermeable by reason of fibre size and density, and hydrophobicity of the fibres.

Some polymers used for fibre production for nonwoven web 21 may be inherently hydrophobic, and for certain applications they may be surface treated or coated with various agents to render them hydrophilic. A surface coating may include a surfactant coating. One such surfactant coating is available from Sehill & Silacher GmbH, Boblingen, Germany, under the trade name Silastol PHP 90.

Nonwoven textile materials suitable for use according to the present invention advantageously include nonwoven textile materials manufactured by spun-laid (melt-blown, spun-bond) technology.

The spun-bond technology process consists in extrusion spinning of a polymer melt. Production line may include one or more extruder heads adapted for production of spun-bond type fibres. Each of the extruder heads is connected to at least one extruder which is fed in doses with required polymer blend. The blend is melted in the extruder and is transported to the spinneret. It is well known in the field that various configuration of the spinnerets may be used to obtain fibres with various cross-section shape and diameter. The spun-bond type fibres, formed by the extruder head, fall on a moving surface, such as a perforated belt. In case of more extruder heads following each other, the fibres from the second and every other head fall onto the fibre layer created by the preceding extruder heads.

A possibility of incorporating one or more extruder heads, for example, of melt-blown, advance melt blown or melt fibrillation type, between the spun-bond heads, and this way inserting between the spun-bond layers a typically barrier layer with a considerably lower fibre diameter, is also well known in the field. These composites are known as SMS materials in the field.

The fibre layer 21*a* created by all the extruder heads used, includes individual fibres, among which usually a mutual coupling is not created yet, even if they may be coupled in certain manner, this preliminary coupling occurring in the process of laying the layer constituted by loose fibres, or shortly after it, alternatively it can be reached by a preliminary calendering.

This preliminary coupling, however, still enables free movement of a substantial number of the fibres, which means that they may be moved. This fibre layer 21*a* may be bonded by means of the calender giving rise to the nonwoven web 21, as described above.

The nonwoven web 21 according to the present invention may be created of one or more granulated material on the basis of polymer materials, such as especially polyolefins, polyesters, polyamides, in particular, for example, polypropylene (PP), polyethylene (PE), polylactic acid (PLA), polyethylene terephthalte (PET) and/or blends of these materials. The nonwoven web 21 according to the present invention may be also created of copolymers based on the materials mentioned above, or may contain these materials as additives and/or modifiers.

The materials containing polypropylene may be especially suitable, because the polypropylene has a relatively low price, and fibres produced of it have favourable properties as concerns surface friction (i. e. they have relatively smooth surface, which is slippery when touched). But materials containing polyethylene may also be suitable, because of its relative softness/suppleness and more preferably frictional properties of its smooth/slippery surface.

Also copolymers based on a combination of polypropylene and ethylene components are particularly suitable. Properties different from those of polypropylene and polyethylene may be achieved by a suitable selection of a ratio and arrangement of the components in a molecule of the polymer. Resulting perception of a nonwoven web 21 may be completely changed by addition of a copolymer in the polymer blend.

Fibres for the nonwoven web 21 production may also be formed, for example, from components, such as aliphatic polyesters, thermoplastic polysaccharides or other biopolymers, or they may contain these substances as additives or modifiers.

The individual fibres may be mono-component or multi-component. Especially bi-component fibres, such as in a core-and sheath or side-by-side arrangement, belong to multi-component fibres. The individual components often include aliphatic polyolefins, such as polypropylene or polyethylene, or also their copolymers, aliphatic polyesters, thermoplastic polysaccharides or other biopolymers.

The fibres of the side-by-side type may be used advantageously in production of high-bulk materials. Application of suitable polymers in the individual components of the two-component fibre may result in, for example, so called self-crimped fibres that significantly increase the bulkiness of the nonwoven web 21. For example, European patent EP0685579 of Kimberly Clark describes a combination of the polypropylene and polyethylene. Another European patent EP1129247, of the same company, describes a combination of different polypropylenes. A difference rate of the individual properties described, is crucial here. Core-and-sheath type fibres may be advantageously used to gain combined properties from the two different polymer components. For example, it is possible to use the component with a higher tensile strength as the core, and the component with a better handle as the sheath. Or, it is possible, for example, to place the component with a lower melting point into the sheath so that it will have an effect of a bonding agent in the process of thermal bonding of the nonwoven web. Person skilled in the art realizes easily further various possibilities and advantages of the use of various fibre types.

A solution according to the present invention may be implemented as a spun-laid nonwoven web containing largely spun-bond fibres formed of at least 80%, preferably at least 85%, more preferably at least 90%, advantageously at least 95% polypropylene.

The nonwoven web, prepared this way, containing a combination of bonding impressions 11, 13 according to the present invention is, for example, abrasion resistant at least on one side to the extent that the abrasion resistance test with 80 rev shows, as an average of 10 measuring, at most degree 3, preferably at most degree 2,5, advantageously at most degree 2. Person skilled in the art realizes easily that the above mentioned values are not valid for special cases, such as a use of crimped fibres.

The nonwoven web 21, prepared this way, containing a combination of bonding impressions 11, 13 according to the present invention, shows, for example, the volume mass of at most 75 kg/m$^3$, preferably at most 70 kg/m$^3$, more preferably at most 65 kg/m$^3$, advantageously at most 60 kg/m$^3$. Person skilled in the art realizes easily that the above mentioned values are not valid for special cases, when, for example, such an additive, which generally decreases a thickness of the final material, is used in a polymer blend (for example, an application of a component significantly increasing fibre flexibility).

Nonwoven webs 21 can be manufactured with any basis weight. It is known in the field, that the higher basis weight is related to a larger measurable thickness and an improved handle of the resulting nonwoven web, but also to a proportionally higher costs. On the other hand, though the lower basis weight is related to proportionally lower costs, at the same time it complicates formation of covering outer layer, which has a distinct 3D appearance and maintains it even after being compressed in a roll, and which has also convenient mechanical properties. It is believed that a solution according to the present invention enables to reach a required balance between keeping material costs under control on the one hand, and the distinct 3D appearance and the convenient mechanical properties on the other hand. It is supposed that sizes and distribution of the bonding impressions 11, 13, and the visually primary and secondary patterns 10, 12 which they form, may be useful especially in case of a use of the nonwoven webs 21 with relatively low basis weight, when such characteristics should enable an improvement of the perceived material bulkiness simultaneously with a reduction of its weight or at least without simultaneous increasing of its weight. In accordance with this assumption, it is possible to use the nonwoven web 21 having the basis weight at most 50 g/m$^2$, preferably at most 40 g/m$^2$, more preferably at most 30 g/m$^2$, advantageously at most 26 g/m$^2$, in such cases. Person skilled in the art realizes, that it is necessary for the nonwoven web 21 to contain at least minimum material quantity in order that the required properties may be reached. In accordance with this assumption, it is possible to use the nonwoven web 21 having the basis weight at least 6 g/m$^2$, preferably at least 8 g/m$^2$, advantageously at least 10 g/m$^2$, in such cases.

In other cases, for example, when using the nonwoven webs 21 for production of articles, such as disposable garments, wipes or dusters, higher basis weights amounting up to 100 g/m2 or even 150 g/m2 may be required. In this context it is believed, that properties of the bonding protrusions, shapes of the bonding impressions 11, 13 and the bonding patterns here described, may have a beneficial influence on the material handle and/or on a perception of its bulkiness and softness, namely even with the nonwoven webs 21 having such higher basis weights. The optimal basis weight is given by both the various requirements related to the individual way of use, and amount of the material cost.

It is believed that for an absorbent article the desired overall visual softness signals of a back-sheet laminate may be better achieved when the back-sheet laminate is substantially white in colour, and has an opacity of at least 45%, more preferably at least 70%, even more preferably at least 73%, and still more preferably at least 75%, as measured by the opacity measurement method set forth below. Accordingly, it may be desirable to add a white-tinting/opacifying agent also to the polymer(s) forming the polymeric film, and to the polymer(s) supplying the spinnerets used to form the fibres for the nonwoven web 21.

While a variety of whitening/opacifying agents may suffice, it is believed that titanium dioxide ($TiO^2$) may be particularly effective because of its brightness and relatively high refractive index.

Opacity can also be enhanced by using fibres having cross-sectional shapes other than round and solid (non-hollow) geometries, namely trilobal or multilobal cross-sections, or hollow configurations or combinations thereof Those non-circular cross-sectional shapes can also provide advantages in terms of bulkiness and compression resilience.

EXAMPLES

In the following examples of manufacture of nonwoven webs 21, a batt 21*a* was produced from spun-bond type beams on REICOFIL technology using the following combinations of the bonding impressions:

Pattern A according to the invention (FIG. 2)
Pattern B according to the invention (FIG. 3)
Pattern C according to the invention (FIG. 4)
Pattern D according to the invention (FIG. 5)
Pattern E according to the invention (FIG. 6)
Pattern F according to the invention (FIG. 7)

Figure 8:
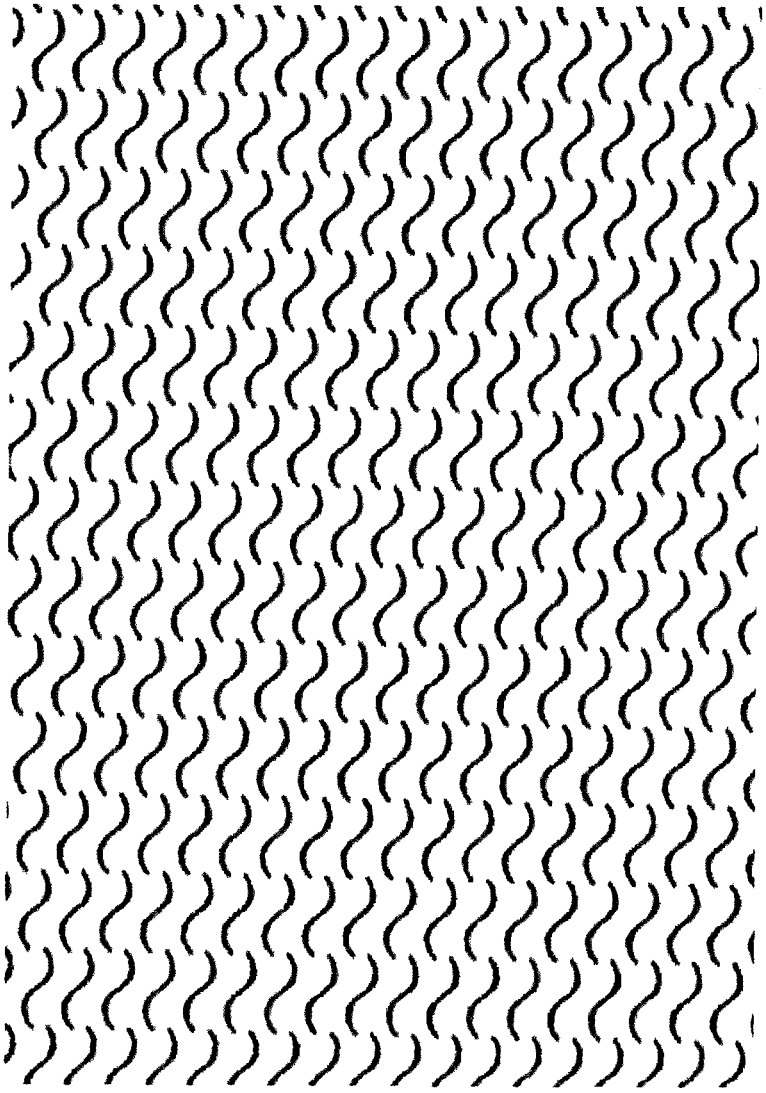
FIG. 8 shows a comparative arrangement of bonding impressions—pattern G—described in WO2012130414.

Comparative "standard" pattern G described in the patent application WO2012130414 as "Pattern of S shape" and depicted therein at FIG. 6 (FIG. 8)

Figure 9:
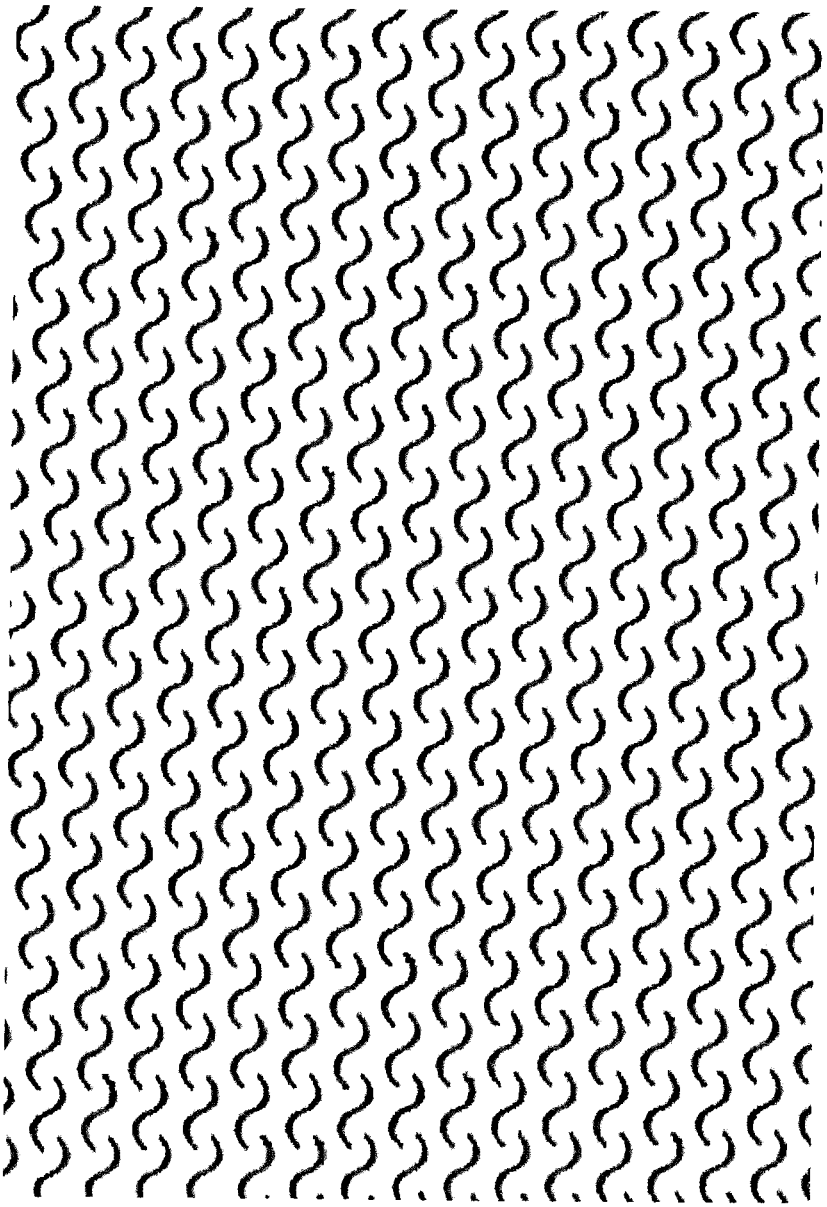
FIG. 9 shows a comparative arrangement of bonding impressions—pattern H—described in WO2012130414.

Comparative "standard" pattern H described in the patent application WO2012130414 as "Modified Pattern S" and depicted therein at FIG. 7 (FIG. 9)

Figure 10:
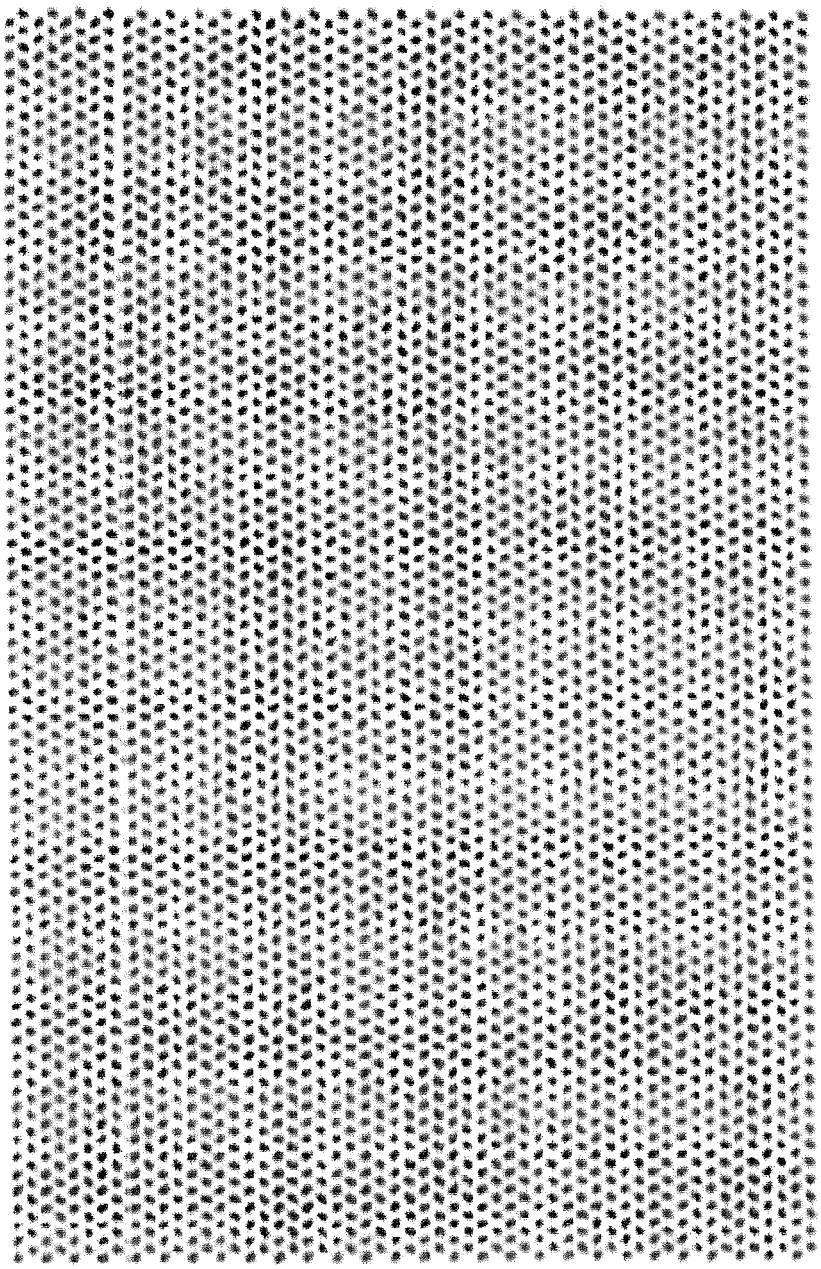
FIG. 10 shows a comparative arrangement of bonding impressions—pattern I.

Comparative "standard" pattern I is used by Ungricht GmbH, Germany (oval shape, known as Pattern U2888) (FIG. 10).

Summary of patterns A, B, C properties—patterns according to the invention with discontinuous distribution of visually primary patterns:

| | Pattern A | Pattern B | Pattern C |
|---|---|---|---|
| Bond area percentage | 14% | 14% | 13.5% |
| Bonding protrusion height on engraved roller | 0.75 mm | 0.75 mm | 0.75 mm |
| Repeated pattern | | | |
| Length | 39.37 mm | 50.72 mm | 50.72 mm |
| Width | 39.37 mm | 39.46 mm | 44.10 mm |
| Area | 1550 $mm^2$ | 1557 $mm^2$ | 2237 $mm^2$ |
| Inclination | 5.2° | 5.2° | 8.2° |
| Visually primary pattern (VPP) | | | |
| Number of VPP types | 2 | 2 | 1 |
| Number of VPP in one repeated pattern | 4 | 4 | 2 |
| Ratio of basic bonding impressions bonding area to the total bonding area | 68% | 64% | |
| Single basic bonding impression area | 1.1-4.0 $mm^2$ | 1.5-5.8 $mm^2$ | 1.2-00.0 $mm^2$ |
| Minimal distance between basic bonding impressions | 0.8 mm | 0.8 mm | 3 mm |
| Minimal distance between VPP | 9 mm | 8 mm | 8 mm |
| Diameter of a circle circumscribed to the largest VPP | 22 mm | 20 mm | 35 mm |
| Diameter of a circle circumscribed to the smallest VPP | 14 mm | 13 mm | — |
| Auxiliary impressions | | | |
| Auxiliary impression types number | 1 | 2 | 1 |
| Distribution | homogenous | homogenous | homogenous |
| Ratio of auxiliary bonding impressions bond area to the total bond area | 32% | 36% | |
| Single impression shape | circle | oval + circle | circle |
| Single impression area | 0.2 $mm^2$ | 0.2-0.4 $mm^2$ | 0.2 $mm^2$ |
| Distance between auxiliary impressions | 1.2 mm | 3 mm | 1.5 mm |
| Area covered by homogenously distributed auxiliary impressions | 76% | 72% | 65% |

Summary of patterns D, E, F characteristics—patterns according to the invention with continuous distribution of visually primary patterns:

| | Pattern E | Pattern D | Pattern F |
|---|---|---|---|
| Bond area percentage | 13.2% | 13.1% | 14.0% |
| Bonding protrusion height on engraved roller | 0.75 mm | 0.75 mm | 0.75 mm |
| Repeated pattern | | | |
| Length | 18.13 mm | 50.55 mm | 43.5 mm |
| Width | 20.72 mm | 50.55 mm | 47.5 mm |
| Area | 376 $mm^2$ | 2555 $mm^2$ | 2066 $mm^2$ |
| Inclination | 3.9° | 9.5° | 8.9° |

-continued

| | Pattern E | Pattern D | Pattern F |
|---|---|---|---|
| Visually primary pattern (VPP) | | | |
| Ratio of basic bonding impressions bonding area to the total bonding area | | 53% | |
| Number of VPP types | 3 | 1 | Many |
| Single basic bonding impression area | 1.1-1.8 $mm^2$ | 1.6 $mm^2$ | 1.1-3.5 $mm^2$ |
| Minimal distance between basic bonding impressions | 0.7 mm | 0.8 mm | 1 mm |
| Diameter of circle circumscribed VPP | 21 mm | 50 mm | 33 mm |
| Auxiliary impressions | | | |
| Auxiliary impression types number | 2 | 1 | many |
| Distribution | Homogenous + line | line | line |
| Ratio of the auxiliary bonding impressions bonding area to the total bonding area | | 47% | |
| Single impression shape | circle | circle | circle |
| Single impression area | 0.2-0.3 $mm^2$ | 0.2 $mm^2$ | 0.2-0.9 $mm^2$ |
| Minimal distance between auxiliary impressions | Line 0.6 mm Homogenous 1 mm | 0.5 mm | 0.9 mm |
| Area covered by homogenously distributed auxiliary impressions | 30% | 0% | 0% |

For example, spun-melt type "Nonwoven batt I" is produced, using 3 following spun-bond beams of RECOFIL 4 technology in a direct continuous process, from polypropylene (Tatren HT2511 from Slovnaft Comp), whereat monocomponent polypropylene fibres with a diameter 15-25 μm are produced and subsequently collected on a moving belt.

Example 1 (25 $g/m^2$, Pattern E According to the Present Invention)

Nonwoven batt I with basis weight 25 $g/m^2$ thermally bonded by a calender consisting of a pair of heated calender rollers 50, 51, one of them being equipped with the raised pattern referred to as pattern E (FIG. 6). The calendering rollers 50, 51 (smooth roller/patterned roller) temperature is 170° C./175° C. and the pressure is 80 N/mm.

Example 2 (25 $g/m^2$, Pattern A According to the Present Invention)

Nonwoven batt I with basis weight 25 $g/m^2$ thermally bonded by a calender consisting of a pair of heated calender rollers 50, 51, one of them being equipped with the raised pattern referred to as pattern A (FIG. 2). The calendering rollers 50, 51 (smooth roller/patterned roller) temperature is 170° C./175° C. and the pressure is 80 N/mm.

Example 3 (25 g/m2, Pattern D According to the Present Invention)

Nonwoven batt I with basis weight 25 g/m$^2$ thermally bonded by a calender consisting of a pair of heated calender rollers 50, 51, one of them being equipped with the raised pattern referred to as pattern D (FIG. 5). The calendering rollers 50, 51 (smooth roller/patterned roller) temperature is 170° C./175° C. and the pressure is 80 N/mm.

Example 4 (25 g/m$^2$, Pattern I—Comparative)

Nonwoven batt I with basis weight 25 g/m$^2$ produced from a polymer mixture with addition of 0.5% so called colour masterbatch (Sanylene white PPRC 70 from Clariant). The nonwoven batt is then thermally bonded using a calender consisting of a pair of heated calender rollers 50, 51, one of them being equipped with the raised pattern referred to as pattern I (FIG. 10). The calendering rollers 50, 51 (smooth roller/patterned roller) temperature is 170° C./175° C. and the pressure is 80 N/mm.

Example 5 (25 g/m$^2$, Pattern H—Comparative)

Nonwoven batt I with basis weight 25 g/m$^2$ thermally bonded by a calender consisting of a pair of heated calender rollers 50, 51, one of them being equipped with the raised pattern referred to as pattern H (FIG. 9). The calendering rollers 50, 51 (smooth roller/patterned roller) temperature is 170° C./175° C. and the pressure is 80 N/mm.

Example 6 (15 g/m$^2$, Pattern E According to the Present Invention)

Nonwoven batt I with basis weight 15 g/m$^2$ produced from a polymer mixture with addition of 0.5% so called colour masterbatch (Sanylene white PPRC 70 from Clariant). The nonwoven batt is then thermally bonded using a calender consisting of a pair of heated calender rollers 50, 51, one of them being equipped with the raised pattern referred to as pattern E (FIG. 6). The calendering rollers 50, 51 (smooth roller/patterned roller) temperature is 170° C./175° C. and the pressure is 80 N/mm.

Example 7 (19 g/m$^2$, Pattern D According to the Present Invention)

Nonwoven batt I with basis weight 19 g/m$^2$ produced from a polymer mixture with addition of 0.5% so called colour masterbatch (Sanylene white PPRC 70 from Clariant). The nonwoven batt is then thermally bonded using a calender consisting of a pair of heated calender rollers 50, 51, one of them being equipped with the raised pattern referred to as pattern D (FIG. 5). The calendering rollers 50, 51 (smooth roller/patterned roller) temperature is 170° C./175° C. and the pressure is 80 N/mm.

For example, spun-melt type "Nonwoven batt II" is produced, using a single spun-bond beam of RECOFIL 4 technology in a direct continuous process, from polypropylene (Tatren HT2511 from Slovnaft Comp), whereat monocomponent polypropylene fibres with a diameter 15-25 μm are produced and subsequently collected on a moving belt.

Example 8 (25 g/m$^2$, Pattern B—According to the Present Invention)

Figure 3:
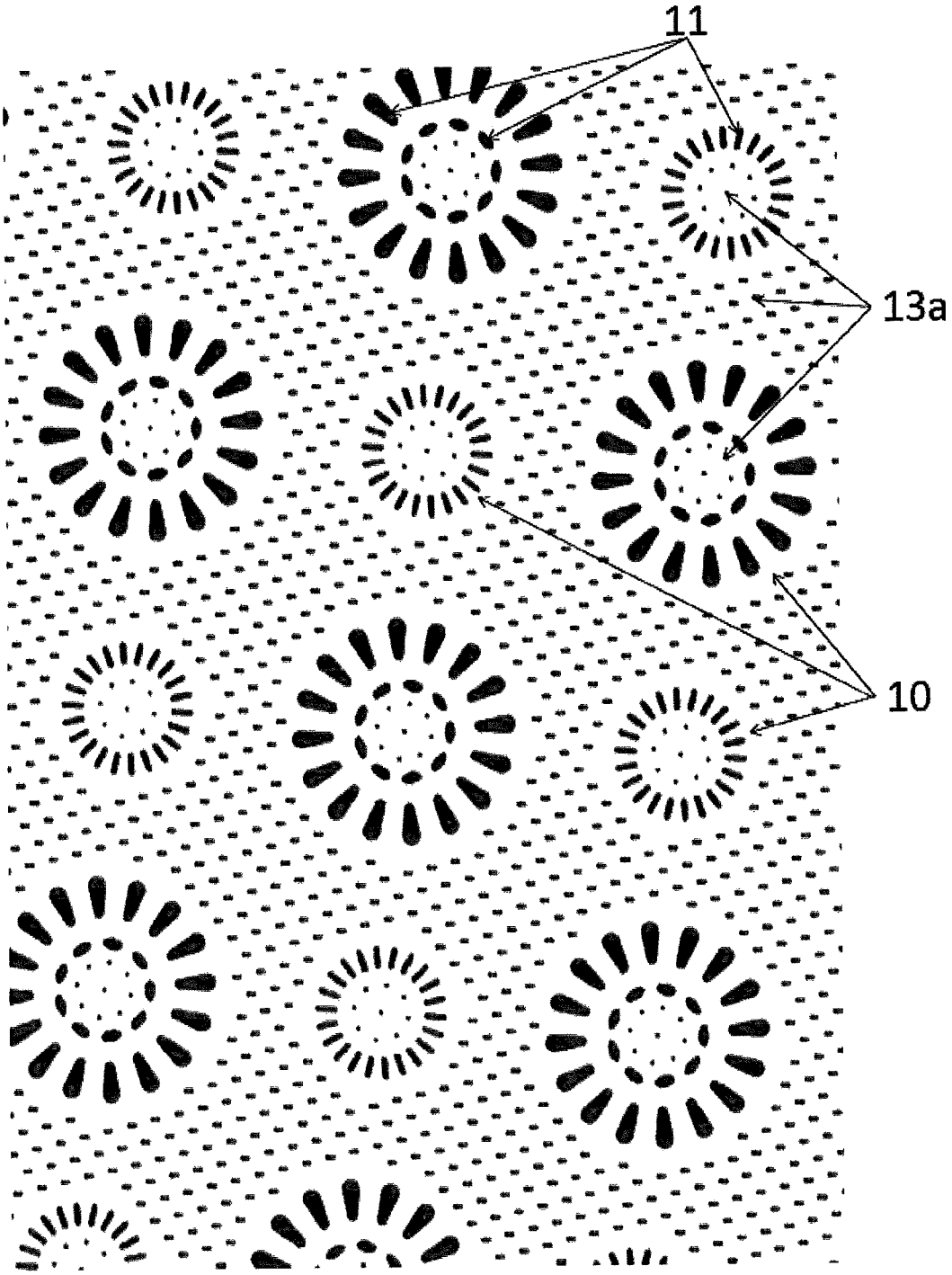
FIG. 3 shows an arrangement of bonding impressions according to the invention—pattern B.
Figure 4:
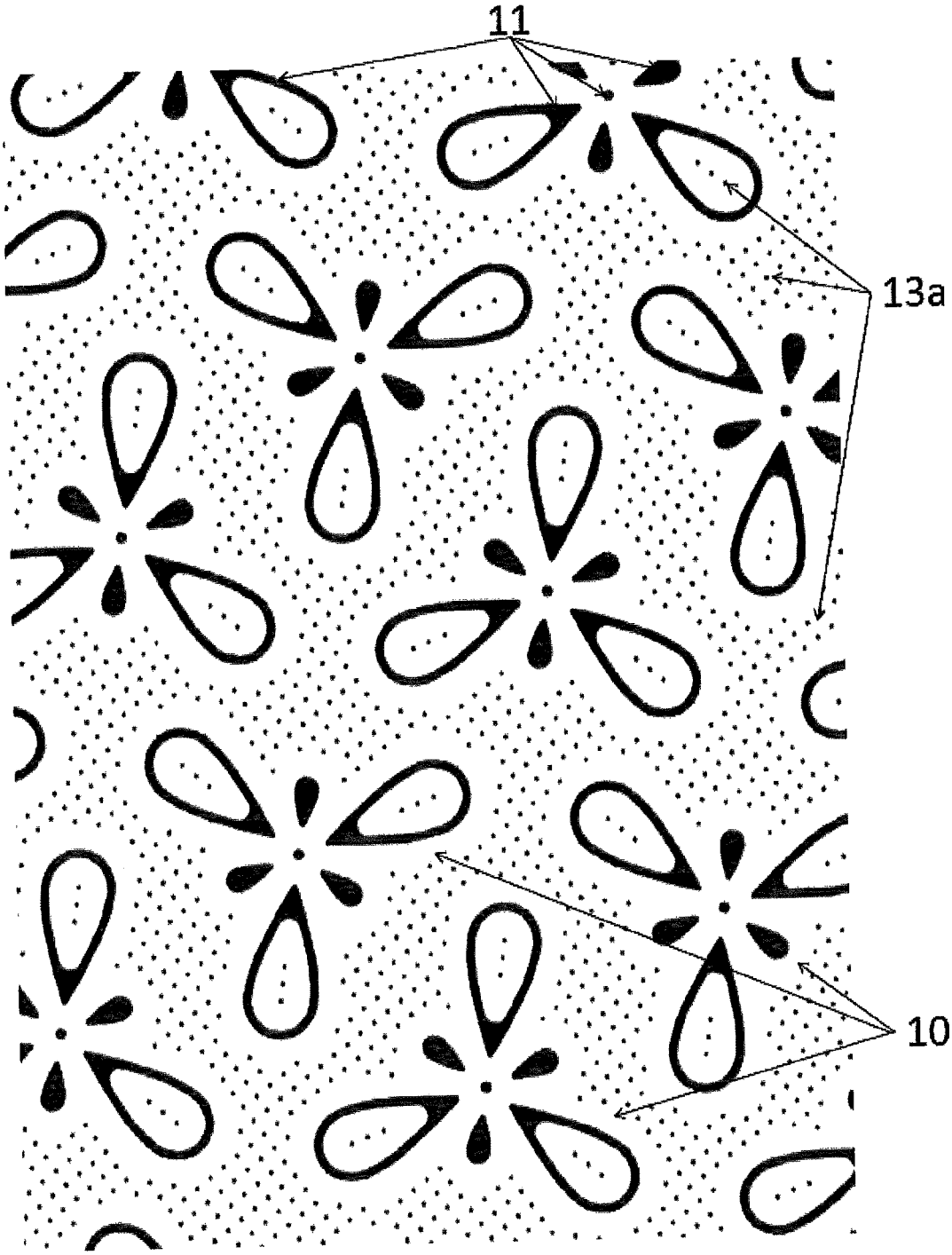
FIG. 4 shows an arrangement of bonding impressions according to the invention—pattern C.

Nonwoven batt II with basis weight 25 g/m$^2$ produced from a polymer mixture with addition of 0.5% so called colour masterbatch (Sanylene white PPRC 70 from Clariant). The nonwoven batt is then thermally bonded using a calender consisting of a pair of heated calender rollers 50, 51, one of them being equipped with the raised pattern referred to as pattern B (FIG. 3). The calendering rollers 50, 51 (smooth roller/patterned roller) temperature is 165° C./170° C. and the pressure is 60 N/mm.

Example 9 (25 g/m$^2$, Pattern F—According to the Present Invention)

Nonwoven batt II with basis weight 25 g/m$^2$ produced from a polymer mixture with addition of 0.5% so called colour masterbatch (Sanylene white PPRC 70 from Clariant). The nonwoven batt is then thermally bonded using a calender consisting of a pair of heated calender rollers 50, 51, one of them being equipped with the raised pattern referred to as pattern F (FIG. 7). The calendering rollers 50, 51 (smooth roller/patterned roller) temperature is 165° C./170° C. and the pressure is 60 N/mm.

| Group of examples | Example | Measured basis weight (g/m$^2$) | Bonding impressions pattern | Tensile strength MD [N/5 cm] | Tensile strength CD [N/5 cm] | Elongation at break MD [%] | Elongation at break CD [%] | Abrasion - smooth side | Abrasion from the side of gravure impression | Thickness [mm] | Volume mass (kg/m$^3$) |
|---|---|---|---|---|---|---|---|---|---|---|---|
| Nonwoven batt I | 1 | 26.1 | E | 56 | 33 | 66 | 71 | 1.0 | 1.0 | 0.41 | 64 |
| | 2 | 25.1 | A | 47 | 27 | 59 | 60 | 3.0 | 1.0 | 0.41 | 62 |
| | 3 | 24.8 | D | 47 | 25 | 52 | 55 | 2.2 | 1.0 | 0.39 | 64 |
| | 4 | 24.8 | I | 65 | 37 | 74.4 | 74 | — | — | 0.29 | 85 |
| | 5 | 23.8 | H | 52 | 28 | 72 | 83 | 1.4 | 1.0 | 0.34 | 71 |
| | 6 | 15.6 | E | 32 | 17 | 58 | 76 | 1.4 | 1.0 | 0.27 | 57 |
| | 7 | 18.9 | D | 30 | 17 | 41 | 58 | 3.0 | 1.0 | 0.32 | 59 |
| Nonwoven batt II | 8 | 25.8 | B | 44 | 32 | 67 | 80 | 1.0 | 1.0 | 0.48 | 54 |
| | 9 | 25.5 | F | 43 | 30 | 64 | 79 | 1.0 | 1.3 | 0.45 | 57 |

From the above mentioned results it is obvious that standard pattern I (Example 4) deviates from other results in most of parameters. 18% of a bonding area of the pattern is created by bonding impressions having oval shape 0.52×0.88 mm (single impression area is 0.5 mm$^2$). The impression system arranged in this way yields, above all, considerably increased tensile strength both in MD and CD direction, at the cost of considerably decreased thickness of the nonwoven web. From a comparison of the patterns according to the present invention (E, A, D) with the standard pattern on the same material composition and with the same basis weight, an increase of thickness with the patterns according to the present invention by, on an average, 0.1 mm, which represents full third of the standard sample, is evident.

The second comparative pattern H (Example 5), borrowed from the patent application WO2012130414, is very similar, with regard to its mechanical properties, to the patterns according to the present invention, when, for example, a tensile strength is slightly lower, when compared with Pattern E (Example 1), and slightly higher, when compared with patterns A and D (Examples 2 and 3). The samples are also fully comparable from the abrasion point of view, taking into consideration the above mentioned possible worse results from a smooth side of the nonwoven web, due to the effect of process conditions of manufacturing (Examples 2+3). All of them achieved the best rating from the side of a gravure impression. The thickness of the materials according to the present invention is higher, when compared with the comparative pattern H, in all these cases, namely by, on an average, 0.05 mm, e. i. by 15%.

Even more significant differences in the thickness of materials according to the present invention, when compared with the comparative materials, were estimated in subjective evaluation. It is probably an influence of a bulkiness expectation induced by a general appearance of the nonwoven web, which means by a combination of a visually primary pattern 10 and a system of auxiliary impressions 13 as the solution according to the present invention. Contrary to the comparative patterns, created by a homogenous distribution of the same bonding impressions (ovals in the pattern I, and a shape resembling the letter S in the pattern H), the patterns, used in examples according to the present invention, create a design formed by bonding impressions of various shapes. For example, pattern E may remind observer of a cable stitch pattern used in knitted sweaters, and so give the impression of a distinct 3D structure. Or, for example, pattern A may give the impression of suns or nosegays, which quasi protrude from a background formed by the auxiliary bonds. On the contrary it may remind another observer of, for example, outlets or sinks embedded into a nonwoven web surface, which are able to drain a liquid from its surface. Or, for example, pattern D may remind an observer of scattered shells. On the contrary, it may remind another observer of a quilt. In all examples according to the present invention mentioned above, a general pattern appearance gives the impression of a distinct 3D structure, and according to an impression of the individual observers may evoke even an expectation as regard to other properties of the nonwoven web.

Further examples show the use of the patterns according to the present invention on various material compositions, and show, that the higher material thickness, when compared with standard, is not dependent on a material composition.

For example, spun-melt type "Nonwoven batt III" is produced, using 3 following spun-bond beams of RECOFIL 4 technology in a direct continuous process, from the mixture of polypropylene (Tatren HT2511 from Slovnaft Comp), 15% of polypropylene copolymer (Vistamaxx 6202 from Exxon) and 2.5% of softener (CESA PPA0050079 from Clariant), whereat mono-component polypropylene fibres with a diameter 15-25 μm are produced and subsequently collected on a moving belt.

Example 10 (25 g/m$^2$, Pattern E—According to the Present Invention)

Nonwoven batt III with a basis weight 25 g/m$^2$, thermally bonded by a calender consisting of a pair of heated calender rollers 50, 51, one of them being equipped with the raised pattern referred to as pattern E (FIG. 6). The calendering rollers 50, 51 (smooth roller/patterned roller) temperature is 160° C./164° C. and the pressure is 75 N/mm.

Example 11 (25 g/m$^2$, Pattern A—According to the Present Invention)

Nonwoven batt III with a basis weight 25 g/m$^2$, thermally bonded by a calender consisting of a pair of heated calender rollers 50, 51, one of them being equipped with the raised pattern referred to as pattern A (FIG. 2). The calendering rollers 50, 51 (smooth roller/patterned roller) temperature is 160° C./164° C. and the pressure is 75 N/mm Example 12 (25 g/m$^2$, Pattern G—Comparative)

Nonwoven batt III with a basis weight 25 g/m$^2$, thermally bonded by a calender consisting of a pair of heated calender rollers 50, 51, one of them being equipped with the raised pattern referred to as pattern G (FIG. 8). The calendering rollers 50, 51 (smooth roller/patterned roller) temperature is 160° C./164° C. and the pressure is 75 N/mm.

Example 13 (25 g/m$^2$, Pattern A—According to the Present Invention)

Nonwoven batt III with basis weight 15 g/m$^2$ produced from a polymer mixture with addition of 0.5% so called colour masterbatch (Sanylene white PPRC 70 from Clariant). The nonwoven batt is then thermally bonded using a calender consisting of a pair of heated calender rollers 50, 51, one of them being equipped with the raised pattern referred to as pattern A (FIG. 2). The calendering rollers 50, 51 (smooth roller/patterned roller) temperature is 160° C./164° C. and the pressure is 75 N/mm.

For example, spun-melt type "Nonwoven batt IV" is produced, using a single spun-bond beam of RECOFIL 4 technology in a direct continuous process, from the mixture of polypropylene (Tatren HT2511 from Slovnaft), 15% of polypropylene copolymer (Vistamaxx 6202 from Exxon), 2.5% of softener (CESA PPA0050079 from Clariant), and 0.5% so called colour masterbatch (Sanylene white PPRC 70 from Clariant), whereat mono-component polypropylene fibres with a diameter 15-25 μm are produced and subsequently collected on a moving belt.

Example 14 (25 g/m$^2$, Pattern B—According to the Present Invention)

Nonwoven batt IV with a basis weight 25 g/m$^2$, thermally bonded using a calender consisting of a pair of heated calender rollers 50, 51, one of them being equipped with the raised pattern referred to as pattern B (FIG. 3). The calendering rollers 50, 51 (smooth roller/patterned roller) temperature is 160° C./165° C. and the pressure is 75 N/mm.

Example 15 (25 g/m$^2$, Pattern F—According to the Present Invention)

Nonwoven batt IV with a basis weight 25 g/m$^2$, thermally bonded using a calender consisting of a pair of heated calender rollers 50, 51, one of them being equipped with the raised pattern referred to as pattern F (FIG. 7). The calendering rollers 50, 51 (smooth roller/patterned roller) temperature is 160° C./165° C. and the pressure is 75 N/mm.

For example, spun-melt type "Nonwoven batt V" is produced, using 3 following spun-bond beams of RECOFIL 4 technology in a direct continuous process, whereat monocomponent polypropylene fibres with a diameter 15-25 μm are produced. The first spun bond beam is supplied with a mixture of polypropylene (Tatren HT2511 from Slovnaft), 15% of polypropylene copolymer (Vistamaxx 6202 from Exxon), 2.5% of softener (CESA PPA0050079 from Clariant), and 0.5% so called colour masterbatch (Sanylene white PPRC 70 from Clariant), and the second spun- bond beam is supplied with polypropylene (Tatren HT2511 from Slovnaft) with addition of 0.5% so called colour masterbatch (Sanylene white PPRC 70 from Clariant). The manufactured fibres are subsequently collected on a moving belt.

Example 16 (25 g/m$^2$, Pattern E—According to the Present Invention)

Nonwoven batt V with a basis weight 25 g/m$^2$, thermally bonded using a calender consisting of a pair of heated calender rollers 50, 51, one of them being equipped with the raised pattern referred to as pattern E (FIG. 6). The calendering rollers 50, 51 (smooth roller/patterned roller) temperature is 160° C./165° C. and the pressure is 75 N/mm.

Example 17 (25 g/m$^2$, Pattern A—According to the Present Invention)

Nonwoven batt V with a basis weight 25 g/m$^2$, thermally bonded using a calender consisting of a pair of heated calender rollers 50, 51, one of them being equipped with the raised pattern referred to as pattern A (FIG. 2). The calendering rollers 50, 51 (smooth roller/patterned roller) temperature is 160° C./165° C. and the pressure is 75 N/mm.

Example 18 (25 g/m$^2$, Pattern B—According to the Present Invention)

Nonwoven batt VI with a basis weight 25 g/m$^2$, thermally bonded using a calender consisting of a pair of heated calender rollers 50, 51, one of them being equipped with the raised pattern referred to as pattern B (FIG. 3). The calendering rollers 50, 51 (smooth roller/patterned roller) temperature is 135° C./135° C. and the pressure is 60 N/mm.

Example 19 (25 g/m$^2$, Pattern F—According to the Present Invention)

Nonwoven batt VI with a basis weight 25 g/m$^2$, thermally bonded using a calender consisting of a pair of heated calender rollers 50, 51, one of them being equipped with the raised pattern referred to as pattern F (FIG. 7). The calendering rollers 50, 51 (smooth roller/patterned roller) temperature is 135° C./135° C. and the pressure is 60 N/mm.

For example, spun-melt type "Nonwoven batt VII" is produced from a single spun-bond beam of RECOFIL 4 technology in a direct continuous process, whereat the bicomponent side-by-side fibres are produced, one of the sides of the bicomponent fibre comprising 30% by weight and the second side comprising 70% by weight. The one side is from polypropylene (MR 2002 from Total Petrochemicals) with addition of 5% of softener (CESA PPA0050079 from Clariant) and the second side is from polypropylene (Mosten NB425 from Unipetrol). The produced fibres are then collected on a moving belt.

| Group of examples | Example | Measured basis weight (g/m$^2$) | Bonding impressions pattern | Tensile strength MD [N/5 cm] | Tensile strength CD [N/5 cm] | Elongation at break MD [%] | Elongation at break CD [%] | Abrasion - smooth side | Abrasion from the side of gravure impression | Thickness [mm] | Volume mass (kg/m$^3$) |
|---|---|---|---|---|---|---|---|---|---|---|---|
| Nonwoven batt III | 10 | 25.5 | E | 44 | 25 | 83 | 91 | 1.0 | 1.0 | 0.34 | 74 |
| | 11 | 24.7 | A | 33 | 19 | 67 | 73 | 3.0 | 2.0 | 0.34 | 73 |
| | 12 | 23.7 | G | 32 | 16 | 77 | 108 | — | — | 0.23 | 105 |
| | 13 | 15.4 | A | 26 | 13 | 69 | 83 | 3.0 | 2.0 | 0.24 | 65 |
| Nonwoven batt IV | 14 | 25.6 | B | 30 | 23 | 74 | 97 | 1.7 | 4.0 | 0.38 | 67 |
| | 15 | 23.8 | F | 32 | 26 | 82 | 117 | 1.0 | 1.7 | 0.36 | 66 |
| Nonwoven batt V | 16 | 25.9 | E | 54 | 31 | 76 | 76 | 1.0 | 1.0 | 0.39 | 67 |
| | 17 | 25.6 | A | 47 | 31 | 68 | 78 | 2.6 | 1.6 | 0.39 | 66 |

Examples of Nonwoven batt VI and VII, as stated below, demonstrate the use of the patterns according to the present invention on high-bulk nonwoven textiles formed by crimped fibres. Person skilled in the art realizes that because of the contained fibres nature, abrasion evaluation by means of the method used, is ungrounded.

For example, spun-melt type "Nonwoven batt VI" is produced from a single spun-bond beam of RECOFIL 4 technology in a direct continuous process, whereat the bicomponent side-by-side fibres are produced, each of the sides of the bicomponent fibre comprising 50% by weight. The one side is from polypropylene (Tatren HT2511 from Slovnaft) and the second side is from polyethylene (Aspun 6834). The produced fibres are then collected on a moving belt.

Example 20 (25 g/m$^2$, Pattern B—According to the Present Invention)

Nonwoven batt VI with a basis weight 25 g/m$^2$, thermally bonded using a calender consisting of a pair of heated calender rollers 50, 51, one of them being equipped with the raised pattern referred to as pattern B (FIG. 3). The calendering rollers 50, 51 (smooth roller/patterned roller) temperature is 140° C./145° C. and the pressure is 60 N/mm.

Example 21 (25 g/m$^2$, Pattern F—According to the Present Invention)

Nonwoven batt VI with a basis weight 25 g/m$^2$, thermally bonded using a calender consisting of a pair of heated calender rollers 50, 51, one of them being equipped with the raised pattern referred to as pattern F (FIG. 7). The calendering rollers 50, 51 (smooth roller/patterned roller) temperature is 140° C./145° C. and the pressure is 60 N/mm.

| Group of examples | Example | Measured basis weight ($g/m^2$) | Bonding impressions pattern | Tensile strength MD [N/5 cm] | Tensile strength CD [N/5 cm] | Elongation at break MD [%] | Elongation at break CD [%] | Abrasion - smooth side | Abrasion from the side of gravure impression | Thickness [mm] | Volume mass ($kg/m^3$) |
|---|---|---|---|---|---|---|---|---|---|---|---|
| Nonwoven batt VI | 18 | 25.6 | B | 19 | 12 | 52 | 79 | — | — | 0.46 | 56 |
| | 19 | 25.8 | F | 21 | 13 | 52 | 89 | — | — | 0.46 | 56 |
| Nonwoven batt VII | 20 | 25.7 | B | 20 | 19 | 244 | 246 | — | — | 0.60 | 43 |
| | 21 | 25.6 | F | 14 | 14 | 290 | 297 | — | — | 0.57 | 45 |

The basis weight ($g/m^2$) of a nonwoven web 21 is measured according to the European standard test EN ISO 9073-1:1989 (conforms to WSP 130.1.R4 /12)). There are ten nonwoven web layers used for measurement, sample size 10×10 $cm^2$.

The "thickness" of nonwoven webs is measured according to the European standard test EN ISO 9073-2:1995 (conforms to WSP 120.6.R4 (12) with following modification: 1. It is necessary to perform the measurement on a sample taken from production without it having been exposed to a higher tensile load or a pressure for a period longer than one day (for example, on a roll of the product), otherwise the material has to be lying freely for a period of minimal 24 hours.

2. The overall weight of the upper arm of the machine including adding weight is 130 g.

The "volume mass" is the ratio of basis weight and thickness and indicates the bulkiness and fluffiness of the product, which are important qualities of the nonwoven web 21 according to the present invention. The lower the value, the bulkier is the web.

$$\text{Volume mass } [kg/m^3] = \text{basis weight } [g/m^2]/\text{thickness } [mm]$$

The "tensile strength and elongation" of a nonwoven web is measured according to the standard test EDANA, defined in WSP 110.4.R4 (12), sample width is 50 mm, distance between jaws is 100 mm, speed is 100 mm/min and preliminary load is 0.1 N.

The "abrasion" of a nonwoven web is measured according to the standard test method defined in ASTM D4970, 80 revolutions are used for the measurement (corresponding to 5 cycles).

In the "Bonding impression Shape Measurement Method" area, distance and angle measurements are performed on images generated using a flat bed scanner capable of scanning at a resolution of at least 4800 dpi in reflectance mode (suitable scanner is the Epson Perfection V750 Pro from Epson, USA). Measurements are performed using ImageJ software (Version 1.43u, National Institute of Health, USA) and calibrated against a ruler certified by NIST.

Samples of the subject nonwoven web 21 that are 250 mm by 250 mm are used. It is possible to use even smaller sample if it incorporates the whole repeated pattern. Precondition the samples at about 23° C.±2° C. and about 50%±2% relative humidity for 2 hours prior to testing. Identify the machine direction of the nonwoven web 21 and draw a fine line on each sample along the machine direction to enable scanned images to be aligned.

Place the sample to be measured on the flat bed scanner with the surface bearing the bonding impressions 11, 13 or bond shapes facing downward, with the ruler directly adjacent.

Placement is such that the dimension corresponding to the machine direction of the nonwoven web 21 is parallel to the ruler. A black backing is placed over the specimen and the lid to the scanner is closed. Acquire an image composed of the nonwoven and the ruler at 4800 dpi in reflectance mode in 8 bit greyscale and save the file. Open the image file in Image) and perform a linear calibration using the imaged ruler.

Unless otherwise stated, dimensional and area measurements are made in triplicate of three similar bonding impressions 11, 13 on each sample for 6 similar samples. The 18 values are averaged and reported.

The "percentage of total bonding area". Identify a single repeated pattern of bonding impressions 11, 13 and areas between them, and enlarge the image such that the repeated pattern fill the whole field of view. Using a software for graphical object editing draw a rectangle (preferably right-angled), that circumscribes the subject repeated pattern. Calculate area of the rectangle with an accuracy of 0.001 $mm^2$. Next, with the area tool, trace the individual bonding impressions 11, 13 or portions thereof that are entirely within the repeated pattern/rectangle, and calculate and add the areas of bonding impressions 11, 13 or portions thereof that are entirely within the repeated pattern/rectangle. Round the result to the nearest 0.001 $mm^2$.

Perform the following calculation:

Percentage of total bonding area %=(sum of areas of bonding impressions 11, 13 within the rectangle circumscribed the repeated pattern)/(total area of the rectangle circumscribed the repeated pattern)×100%

Repeat this calculation for a total of three non-adjacent regions randomly selected across the testing sample surface. Round each of the total bonding area percentage, calculated this way, to the nearest 0.01%. Calculate the average and standard deviation of all 18 of the bonding area percentage measurements and round it to the nearest 0.01%.

Individual bonding impression 11, 13 area: enlarge the image of a region of the sample such that edges of a bonding impressions 11, 13 shapes can be identified. With the area tool manually trace the perimeter of a particular bond shape. Calculate and round the area to the nearest 0.001 $mm^2$. Repeat for a total of five non-adjacent areas randomly selected across the total sample surface. The measurements are made on each of the test samples. A total of six samples are measured. Calculate the average and standard deviation of all 30 individual bonding impression area measurements and round it to the nearest 0.001 $mm^2$.

Diameter of a circle circumscribed around the visually primary pattern 10. Enlarge the image of the test sample such that the whole repeated pattern can be depicted. Mark all the bonding impressions that meet the definition of the basic bonding impression 11. Identify the individual visually primary patterns 10 according to the definition.

For example, the bonding pattern A, with discrete (discontinuous) visually primary patterns 10, which is impressed in the nonwoven web 21, is depicted in FIG. 11—i. The pattern contains two different visually primary patterns 10. According to the depiction it is obvious that the individual visually primary patterns 10 are separated by a system of the auxiliary bonding impressions 13.

For example, the bonding pattern E, with continuous visually primary patterns 10, which is impressed in the nonwoven web 21, is depicted in FIG. 11—ii. A scheme of the same pattern is shown in FIG. 11—iii. Individual visually primary patterns 10 continuously follow each other down from top. In this case a single visually primary pattern 10 is created by the smallest repeated system of the basic bonding impressions 11. The whole pattern constituted by the consecutive visually primary patterns 10 can be created using a linear shifting of a single visually primary pattern 10, without it being rotated. A circle 15, circumscribed the single visually primary pattern 10, is shown in FIG. 11—iii.

For example, the bonding pattern D, with continuous visually primary patterns 10, which is impressed in the nonwoven web 21, is depicted in FIG. 11—iv. The individual visually primary patterns 10 continuously follow each other both in MD and in CD directions. Even here several visually primary patterns 10 are marked by a circumscribed circle 15. In this particular case also the basic bonding impressions 11, which are not a part of this visually primary pattern 10, are included inside the circle 15. The circles 15, circumscribed around the individual visually primary patterns 10, overlap in this case.

For example, the bonding pattern F, formed by continuous lines created by rows of bonding impressions 11, 13, the size of which is fluently changed, is depicted in FIG. 11-*v*. After marking the basic bonding impressions 11 (in this particular case bonding impressions with areas over 1 $mm^2$), separated structures of the visually primary patterns 10 and the visually secondary patterns 12 are apparent. Further proceeding is the same as described with FIG. 1—ii. Circumscribed circle 15 drawing: Enlarge the image of the test sample such that the selected visually primary pattern 10 can be displayed well. Mark the basic bonding impressions 11 farthest from the estimated centre of the visually primary pattern 10. Draw the circle 15 circumscribed the visually primary pattern 15 so that all the basic bonding impressions 11, creating the visually primary pattern 10, can be inside the circle 15, or touch the circles 15 from the inside. At least 2 basic bonding impressions 11, contained in the pattern 10, have to touch the circle 15 from the inside.

Measure the radius/diameter 16 of created circumscribed circle 15 with an accuracy of 0.001 mm. Repeat for a total of five non-adjacent areas randomly selected across the total sample surface. The measurements are made on each of the test samples. A total of six samples are measured. Calculate the average and standard deviation of all 30 individual bonding impression 11 area measurements and round it to the nearest 0.001 $mm^2$.

INDUSTRIAL APPLICABILITY OF THE INVENTION

The invention is applicable wherever a subjectively perceived softness and bulkiness of nonwoven web are required—for example in a sanitary industry as various parts of hygienic absorbent articles (such as disposable diapers, incontinence pads, feminine hygienic products, care mats etc.), or in a health service, for example as a part of a protective clothing, operating covering products, mats and other products of personal use. The invention is used advantageously above all in applications, where the requirement of the subjectively perceived softness and bulkiness is combined with specification of basic extent of mechanical properties and abrasion resistance.

Nonwoven webs 21 according to the present invention may be used, for example, in production of absorbent articles, namely in creating top-sheets, back-sheets or loop parts of a hook-and-loop system, or any other parts of these articles, which can be in addition to products of a personal hygiene and cleansing also dusting aids, cleaning textiles and dish towels for household use, clothes-bags, vacuum cleaner bags and blankets and similar articles containing a layer fabricated from the nonwoven web 21 can be.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicant's invention.

The invention claimed is:

1. A nonwoven web comprising heat bondable fibres and comprising bonding impressions that form a pattern repeated in the machine direction (MD), wherein the bonding impressions include:

a. a system of basic bonding impressions, which are arranged to create visually primary patterns and an area of each basic impression is at least 1 $mm^2$, wherein each visually primary pattern is made up of a plurality of basic bonding impressions; and b. a system of auxiliary bonding impressions each having an area smaller than 0.3 $mm^2$, c. wherein a sum of bonding areas of the individual auxiliary bonding impressions accounts for at least 30% of a total bonding area, and d. wherein all of the auxiliary bonding impressions are non-overlapping relative to the basic bonding impressions.

2. The nonwoven web according to claim 1, wherein the area of the individual basic bonding impressions is by at least 300% larger than the individual area of the largest auxiliary bonding impression.

3. The nonwoven web according to claim 1, wherein the nonwoven web comprises heat bondable continuous filaments or is composed of them.

4. The nonwoven web according to claim 3, wherein a size of the individual visually primary patterns, represented by a circumscribed circle diameter, is at the most 100 mm.

5. The nonwoven web according to claim 3, wherein the individual visually primary patterns are arranged so that their spacing is at least three times longer than the shortest distance between two adjacent basic bonding impressions.

6. The nonwoven web according to claim 3, wherein the individual visually primary patterns are next to one another.

7. The nonwoven web according to claim 6, wherein the system of the basic bonding impressions forms a continuous structure created by substantially parallel lines, and the longest distance between these substantially parallel lines is at most 40 mm.

8. The nonwoven web according to claim 3, wherein the auxiliary bonding impressions are arranged with even spacing on at least a part of the repeated pattern area.

9. The nonwoven web according to claim 3, wherein the auxiliary bonding impressions are arranged to form visually secondary patterns on at least a part of the repeated pattern area.

10. The nonwoven web according to claim 3, wherein the nonwoven web has a basis weight equal or less than 50 g/m$^2$.

11. The nonwoven web according to claim 3, wherein the nonwoven web is a spun-laid type nonwoven web comprising spunbond fibres, comprising at least 80% of polypropylene.

12. The nonwoven web according to claim 3, wherein at least one side of the web is abrasion resistant to such a degree that abrasion test with 80 revolutions shows at most degree 3, as an average of 10 measurements.

13. The nonwoven web according to claim 3, wherein the nonwoven web has a volume mass equal or less than 75 kg/m$^3$.

14. The nonwoven web according to claim 3, wherein at least some of the fibres comprise materials selected from the group consisting of aliphatic homopolymers and/or copolymers thereof, aliphatic polyesters and/or copolymers thereof, biopolymers or mixtures of these materials, dyes, or additives altering surface properties of the material.

15. The nonwoven web according to claim 3, wherein at least some of the fibres comprises materials selected from the group consisting of polypropylene, polyethylene, polyethylene-terephthalate (PET), polylactic acid (PLA).

16. The nonwoven web according to claim 7, wherein a longest distance between the substantially parallel lines is at most 35 mm.

17. The nonwoven web according to claim 16, wherein a longest distance between the substantially parallel lines is equal or less than 30 mm.

18. The nonwoven web according to claim 17, wherein a longest distance between the substantially parallel lines is equal or less than 25 mm.

19. The nonwoven web according to claim 18, wherein a longest distance between the substantially parallel lines is equal or less than 20 mm.

20. The nonwoven web according to claim 13, wherein the nonwoven web has a volume mass equal or less than 70 kg/m$^3$.

21. The nonwoven web according to claim 20, wherein the volume mass is equal or less than 65 kg/m$^3$.

22. The nonwoven web according to claim 21, wherein the volume mass is equal or less than 60 kg/m3.

* * * * *